US011478111B2

(12) United States Patent
Osborne, Jr.

(10) Patent No.: US 11,478,111 B2
(45) Date of Patent: Oct. 25, 2022

(54) LOADING AND TRANSFER SYSTEM/ASSEMBLY FOR SHEET MATERIAL DISPENSERS

(71) Applicant: VALVE SOLUTIONS, INC., Alpharetta, GA (US)

(72) Inventor: Charles Agnew Osborne, Jr., Cumming, GA (US)

(73) Assignee: Valve Solutions, Inc., Alpharetta, GA (US)

( * ) Notice: Subject to any disclaimer, the term of this patent is extended or adjusted under 35 U.S.C. 154(b) by 138 days.

(21) Appl. No.: 16/893,516

(22) Filed: Jun. 5, 2020

(65) Prior Publication Data

US 2020/0390295 A1 Dec. 17, 2020

Related U.S. Application Data

(60) Provisional application No. 62/861,425, filed on Jun. 14, 2019.

(51) Int. Cl.
*A47K 10/36* (2006.01)
*A47K 10/38* (2006.01)

(52) U.S. Cl.
CPC ..... *A47K 10/3687* (2013.01); *A47K 10/38* (2013.01)

(58) Field of Classification Search
None
See application file for complete search history.

(56) References Cited

U.S. PATENT DOCUMENTS

| | | | |
|---|---|---|---|
| 2,930,663 | A | 3/1960 | Weiss |
| 3,017,131 | A | 1/1962 | Wooster |
| 3,269,592 | A | 8/1966 | Slye et al. |
| 3,288,387 | A | 11/1966 | Craven, Jr. |
| 3,628,743 | A | 12/1971 | Bastian et al. |

(Continued)

FOREIGN PATENT DOCUMENTS

| | | | |
|---|---|---|---|
| CA | 2760805 | A1 | 11/2010 |
| EP | 0317448 | A1 | 5/1989 |

(Continued)

OTHER PUBLICATIONS

International Search Report and Written Opinion for International Patent Application No. PCT/US2020/036257 dated Sep. 17, 2020.

*Primary Examiner* — William A. Rivera
(74) *Attorney, Agent, or Firm* — Womble Bond Dickinson (US) LLP

(57) ABSTRACT

A sheet material dispenser can include a dispenser housing that supports one or more supplies of sheet material, and a feed roller configured to engage and feed the sheet material from the dispenser housing. The dispenser also can include a sheet material loading assembly including a cover that is rotatably connected the dispenser housing and movable between a closed position and an open position. The sheet material loading assembly further can include a roller that is rotatably connected to the cover and configured to be coupled to a portion of sheet material from one of the supplies, with the cover in its open position, and to press the portion of sheet material into engagement with the feed roller body, with the cover in its closed position, to initiate dispensing of the at least one supply from the dispenser.

22 Claims, 16 Drawing Sheets

(56) References Cited

U.S. PATENT DOCUMENTS 3,730,409 A * 5/1973 Ratti ..... A47K 10/36 225/14
3,843,218 A 10/1974 Krueger et al.
3,858,951 A 1/1975 Rasmussen
3,917,191 A 11/1975 Graham, Jr. et al.
4,010,909 A 3/1977 Bastian
4,067,509 A 1/1978 Graham, Jr. et al.
4,165,138 A 8/1979 Hedge et al.
4,317,547 A 3/1982 Graham, Jr. et al.
4,358,169 A 11/1982 Filipowicz et al.
4,378,912 A 4/1983 Perrin et al.
4,403,748 A 9/1983 Cornell
4,712,461 A 12/1987 Rasmussen
5,131,302 A 7/1992 Watanabe
5,375,785 A 12/1994 Boone et al.
5,400,982 A 3/1995 Collins
5,452,832 A * 9/1995 Niada ..... A47K 10/36 225/10
5,526,973 A 6/1996 Boone et al.
5,558,302 A 9/1996 Jesperson
5,604,992 A 2/1997 Robinson
5,620,128 A 4/1997 Dingman et al.
5,857,393 A 1/1999 Kohiyama
5,924,617 A * 7/1999 LaCount ..... A47K 10/3687 225/16
5,979,821 A 11/1999 LaCount et al.
6,145,779 A 11/2000 Johnson et al.
6,152,397 A 11/2000 Purcell
6,321,963 B1 11/2001 Gracyalny et al.
6,354,533 B1 3/2002 Jespersen
6,412,678 B2 7/2002 Gracyalny et al.
6,460,798 B1 10/2002 Haen et al.
6,592,067 B2 7/2003 Denen et al.
6,648,267 B2 11/2003 Stanland et al.
6,685,074 B2 2/2004 Gracyalny et al.
6,736,348 B1 5/2004 Formon et al.
6,793,170 B2 9/2004 Denen et al.
6,826,985 B2 12/2004 Broehl
6,826,991 B1 12/2004 Rasmussen et al.
6,830,210 B2 12/2004 Formon et al.
6,838,887 B2 1/2005 Denen et al.
6,871,815 B2 3/2005 Moody et al.
6,902,134 B2 * 6/2005 Green ..... A47K 10/38 225/106
7,017,856 B2 3/2006 Moody et al.
7,083,138 B2 8/2006 Elliott et al.
7,114,677 B2 10/2006 Formon et al.
7,168,602 B2 1/2007 Broehl
7,182,288 B2 2/2007 Denen et al.
7,182,289 B2 2/2007 Moody et al.
7,185,841 B2 * 3/2007 Kaufmann ..... A47K 10/32 242/564.4
7,213,782 B2 5/2007 Osborne et al.
7,237,744 B2 7/2007 Morris et al.
7,270,292 B2 9/2007 Rasmussen
7,296,765 B2 11/2007 Rodrian
7,341,170 B2 3/2008 Boone
7,370,824 B1 5/2008 Osborne
7,380,748 B2 6/2008 Goeking et al.
7,422,174 B2 9/2008 Elliott et al.
7,624,664 B2 12/2009 Morris et al.
7,698,980 B2 4/2010 Morris et al.
7,793,882 B2 9/2010 Reinsei et al.
7,832,678 B2 11/2010 Hjort et al.
7,841,558 B2 11/2010 Elliott et al.
7,845,593 B2 12/2010 Formon et al.
7,887,005 B2 * 2/2011 Troutman ..... A47K 10/36 242/563.2
7,946,522 B2 5/2011 Lewis et al.
7,963,475 B2 6/2011 Rodrian
7,967,235 B2 6/2011 Forman et al.
7,980,506 B2 7/2011 Kling et al.
7,987,756 B2 8/2011 Lewis et al.
8,083,170 B2 12/2011 Troutman et al.
8,162,252 B2 4/2012 Cittadino et al.
8,231,076 B2 * 7/2012 Troutman ..... A47K 10/36 242/595
8,418,950 B2 4/2013 Hagleitner
8,439,293 B2 5/2013 Hagleitner
8,448,890 B2 5/2013 Hagleitner
8,464,976 B2 * 6/2013 Mok ..... A47K 10/36 242/564.4
8,496,198 B2 7/2013 Cittadino et al.
8,616,489 B2 12/2013 Goeking et al.
8,777,149 B2 7/2014 Goeking et al.
8,800,415 B2 8/2014 Osborne
8,882,021 B2 11/2014 Cittadino et al.
8,910,898 B2 12/2014 Hagleitner
8,919,688 B2 12/2014 Kuehneman et al.
9,326,648 B2 5/2016 Trampolski
9,370,283 B2 6/2016 Fellhoelter
9,604,811 B2 3/2017 Case et al.
9,645,561 B2 5/2017 Borke et al.
9,661,958 B2 5/2017 Moody et al.
9,681,783 B2 6/2017 Goeking et al.
9,701,508 B2 7/2017 Diamond
9,756,992 B2 9/2017 Osborne
9,839,333 B2 12/2017 Goeking et al.
9,907,441 B2 3/2018 Osborne et al.
9,918,598 B2 3/2018 Osborne
9,999,326 B2 6/2018 Borke et al.
10,105,020 B2 10/2018 Carper et al.
10,123,665 B2 11/2018 Osborne, Jr.
10,136,769 B2 11/2018 Osborne, Jr. et al.
10,441,117 B2 10/2019 Osborne, Jr.
10,602,887 B2 * 3/2020 Troutman ..... A47K 10/36
10,610,064 B2 4/2020 Osborne et al.
10,660,486 B2 5/2020 Osborne, Jr.
11,051,665 B2 * 7/2021 Huang ..... A47K 10/38
2002/0073821 A1 6/2002 Broehl
2002/0109036 A1 8/2002 Denen et al.
2003/0168489 A1 9/2003 Formon et al.
2003/0168550 A1 9/2003 Formon et al.
2003/0169046 A1 9/2003 Morris
2004/0004152 A1 1/2004 Kapiloff et al.
2004/0004153 A1 1/2004 Kapiloff et al.
2004/0134924 A1 7/2004 Hansen et al.
2004/0160234 A1 8/2004 Denen et al.
2004/0178297 A1 9/2004 Moody et al.
2005/0056721 A1 3/2005 Rasmussen et al.
2005/0072874 A1 4/2005 Denen et al.
2005/0127232 A1 6/2005 Moody et al.
2005/0167541 A1 8/2005 Osborne
2006/0034649 A1 2/2006 Han et al.
2008/0011772 A1 1/2008 Morris et al.
2008/0087758 A1 4/2008 Formon et al.
2008/0099595 A1 5/2008 Lewis et al.
2008/0245922 A1 10/2008 Fellhoelter
2009/0314874 A1 12/2009 Kling et al.
2010/0286817 A1 11/2010 Goeking et al.
2010/0286818 A1 11/2010 Goeking et al.
2011/0253829 A1 10/2011 Goeking et al.
2012/0312853 A1 12/2012 Osborne et al.
2013/0248644 A1 9/2013 Goeking et al.
2013/0320130 A1 12/2013 Osborne
2014/0110522 A1 4/2014 Goeking et al.
2014/0263811 A1 9/2014 Goeking et al.
2014/0263812 A1 9/2014 Osborne
2014/0367507 A1 12/2014 Trampolski
2015/0157177 A1 6/2015 Carper et al.
2015/0297043 A1 10/2015 Osborne et al.
2015/0327735 A1 11/2015 Himmelmann
2015/0342423 A1 12/2015 Kling
2016/0347567 A1 12/2016 Tagashira
2016/0353945 A1 12/2016 Osborne
2016/0353946 A1 12/2016 Osborne
2016/0353947 A1 12/2016 Osborne
2017/0055787 A1 3/2017 Borke
2017/0057775 A1 3/2017 Kobs et al.
2017/0074388 A1 3/2017 Cittadino et al.
2017/0112335 A1 4/2017 Diamond
2017/0112336 A1 4/2017 Ruthven et al.
2017/0188759 A1 7/2017 Borke et al.

(56) References Cited

U.S. PATENT DOCUMENTS

| | | | |
|---|---|---|---|
| 2017/0188760 | A1 | 7/2017 | Henson et al. |
| 2017/0190535 | A1 | 7/2017 | Case et al. |
| 2017/0209006 | A1 | 7/2017 | Rozek et al. |
| 2017/0251884 | A1 | 9/2017 | Carignan et al. |
| 2017/0258278 | A1 | 9/2017 | Moody et al. |
| 2017/0290471 | A1 | 10/2017 | Borke et al. |
| 2017/0290472 | A1 | 10/2017 | Borke et al. |
| 2017/0290473 | A1 | 10/2017 | Borke et al. |
| 2017/0367547 | A1 | 12/2017 | Osborne |
| 2018/0110380 | A1 | 4/2018 | Phelps |
| 2018/0146829 | A1 | 5/2018 | Osborne |
| 2018/0153360 | A1 | 6/2018 | Osborne, Jr. et al. |
| 2018/0170703 | A1 | 6/2018 | Osborne, Jr. |
| 2018/0263433 | A1 | 9/2018 | Osborne, Jr. |
| 2018/0263435 | A1 | 9/2018 | Osborne, Jr. |
| 2019/0174972 | A1 | 6/2019 | Osborne, Jr. et al. |
| 2019/0216270 | A1 | 7/2019 | Osborne, Jr. |
| 2019/0307299 | A1 | 10/2019 | Osborne, Jr. |
| 2020/0029751 | A1 | 1/2020 | Osborne, Jr. |
| 2020/0054177 | A1 | 2/2020 | Osborne, Jr. |
| 2020/0163498 | A1 | 5/2020 | Osborne, Jr. |

FOREIGN PATENT DOCUMENTS

| | | | |
|---|---|---|---|
| EP | 1097665 | A2 | 5/2001 |
| EP | 1097665 | A3 | 1/2003 |
| EP | 1321084 | A1 | 6/2003 |
| EP | 1232715 | B1 | 11/2005 |
| EP | 1716800 | A2 | 11/2006 |
| EP | 2377442 | A1 | 10/2011 |
| EP | 2846466 | A3 | 6/2015 |
| EP | 2040594 | B1 | 4/2018 |
| EP | 3007599 | B1 | 6/2018 |
| JP | 2010233971 | A | 10/2010 |
| WO | WO2002/000083 | | 1/2002 |
| WO | WO2008/004919 | | 1/2008 |
| WO | WO2010/129741 | | 11/2010 |
| WO | WO2014/200624 | | 12/2014 |
| WO | WO2016/100462 | | 6/2016 |

* cited by examiner

LOADING AND TRANSFER SYSTEM/ASSEMBLY FOR SHEET MATERIAL DISPENSERS

CROSS-REFERENCE TO RELATED APPLICATIONS

The present application claims the benefit of U.S. Provisional Patent Application No. 62/861,425, filed Jun. 14, 2019.

INCORPORATION BY REFERENCE

The disclosure and figures of U.S. Provisional Patent Application No. 62/861,425, filed Jun. 14, 2019, are incorporated by reference herein as if set forth in their entireties.

TECHNICAL FIELD

The present disclosure is directed to dispensers for flexible sheet materials, and in particular, in one aspect, dispensers with a loading and/or transfer assemblies, mechanisms, or systems. Other aspects also are described.

BACKGROUND

Dispensers for sheet materials, such as for dispensing paper towels, tissue paper, or other paper products, are commonly used in hospitals, restrooms, and other facilities. Loading sheet materials in such dispensers often can prove to be a difficult task. For example, personnel loading the dispensers may have to navigate the sheet material through relatively close or tight clearances between the operative elements, supports and other elements within the dispensers. This can take considerable time and sometimes results in tearing or ripping of the sheet material. Improper loading of the sheet material also is common and can cause jamming of the sheet material in the dispenser, thus resulting in significant down time for the sheet material dispenser.

Additionally, some dispensers can have more than one supply of sheet material, e.g., multiple rolls of sheet material, for dispensing/feeding from the dispensers, and when one of the supply rolls is running low or has been fully dispensed, transfer of the feeding of sheet material to a new supply generally must be manually performed. With some dispensers, when a supply of sheet material is running low, feeding/dispensing is modified such that sheet material from multiple supplies may be dispensed or fed at the same time, i.e., double sheets may be dispensed simultaneously—potentially leading to waste of significant amounts of sheet material.

Accordingly, it can be seen that a need exists for a systems and methods dispenser that addresses the foregoing and other related, and unrelated, problems in the art.

SUMMARY

Briefly described, the present disclosure is generally directed to a dispenser or dispenser assembly for rolled sheet materials, such as paper products including paper towels, tissue paper, etc. and/or other paper products. The dispenser assembly can include a dispenser housing, with one or more support assemblies for supporting one or more supplies of sheet material disposed in or along the dispenser housing. In one embodiment, the one or more supplies of sheet material can include a first supply roll and second supply roll of sheet material. The first or second supply of sheet material can include new, undispensed rolls of sheet material, partially dispensed rolls of sheet material, and/or stub rolls of sheet material. A stub roll of sheet material generally includes a supply roll that has been substantially dispensed, e.g., a supply roll with less than about 50% to about 30% or less of its initial amount of sheet material remaining.

The dispenser assembly further can include a feed roller assembly including one or more feed rollers configured to engage and drive the sheet materials from the one or more supplies of sheet material. The feed roller(s) drive the sheet material along a discharge or feed path from the supply toward and through a discharge of the dispenser housing. The feed roller(s) can be automatically driven, e.g., by one or more powered drive mechanisms, such as a motor or other suitable actuator, or the feed roller(s) can be manually activated, such as by a rotatable knob, handle, or other suitable engagement and/or drive mechanism that can be engaged or rotated by an operator or user.

The dispenser assembly further can include a sheet material loading mechanism/assembly. The sheet material loading mechanism/assembly can include a cover assembly that is movably connected to the dispenser housing. In one example, the cover assembly can include a cover body rotatably or pivotably coupled to a front portion of the dispenser housing, e.g., at a first end of the cover body, and being movable between a closed position and an open position. In the closed position, the cover body at least partially surrounds and/or enclose the feed roller. In its open position, the cover body will be substantially spaced away from the feed roller, e.g., with the cover body extending out and away from the front portion of the dispenser.

The sheet material loading mechanism/assembly further includes a plurality of locking features or locking mechanisms (e.g., biased locking switches or other suitable locking mechanism/features) configured to lock or secure the cover assembly in its closed position. The locking features/mechanisms can be movable or actuatable to release the cover assembly and allow for the cover assembly to be moved to the opening position.

In one embodiment, the cover assembly can be biased towards its open position. For example, the loading mechanism/assembly can include one or more biasing members (e.g., one or more springs, such as torsion springs, or other suitable biasing members) in communication with the cover body and the dispenser housing to bias the cover towards its open position.

The cover assembly further can include a cover roller, which, in some embodiments, can be a pressing or guide roller, connected thereto/integrated therewith. The cover roller can be rotatably connected to the cover body at the second end of the cover body. The cover roller further can be biased or urged (e.g., by one or more biasing members, such as springs or other suitable biasing members) to press or engage the sheet material against the feed roller, with the cover assembly in its closed position. In one example construction, end portions of the cover roller can be received within slots or other suitable openings defined in or otherwise along the second end of the cover body, such that the cover roller is movable therealong. The biasing members further can be coupled to the cover body and can engage the ends or other portions of the cover roller so as to urge the cover roller toward engagement with the feed roller, e.g., the biasing member can bias the ends of the cover roller toward a first end of the slots defined in the cover body.

The cover roller additionally can include one or more sheet material retention features, such as clips, or projections, etc., provided therealong. The sheet material retention features generally are configured to secure the sheet material to the cover roller to help facilitate loading of the sheet material. For example, with the cover assembly in its open position, an operator can connect/engage a portion of the sheet material from the first or second supply roll of sheet material to or about the cover roller by use of the sheet material retention features. Thereafter, the operator can move the cover assembly to its closed position, moving the cover roller into engaging or pressing engagement with the sheet material from the first or second supply roll and against the feed roller. Thereafter, upon actuation of the feed roller, the sheet material can be engaged by the feed roller and urged along the discharge path and toward and through the discharge in the dispenser housing for dispensing a sheet or length of sheet material.

In addition, the dispenser assembly can include a supply roll transfer assembly that can facilitate transfer of feeding of sheet materials between the first and second supply rolls. The transfer assembly can include a transfer arm that is movable between a plurality of positions or configurations to facilitate transfer of feeding between the first and second supply rolls. For example, the transfer arm can be movable between a first position for feeding sheet material from the first supply roll, and a second supply roll position for feeding sheet material from the second supply roll.

When the transfer arm is in the first position, the sheet material from the second supply roll can be engaged with the cover roller of the cover assembly, e.g., via retention features, and the transfer arm can engage a portion of the cover roller such that the cover roller (and the sheet material from the second supply roll engaged therewith) is spaced from the feed roller, sufficient to define a gap or separation spacing between the cover roller and the feed roller. The transfer arm also includes a guide roller rotatably attached to a first end thereof and configured to engage and guide the sheet material from the first supply roll, with the transfer arm in the first position (i.e., when the dispenser assembly is feeding sheet material from the first supply roll). For example, the guide roller can engage and direct the sheet material from the first supply roll so that it is engaged and urged by the feed roller along the discharge path and through the discharge in the dispenser housing with the transfer arm in its first position.

In addition, the supply roll transfer assembly can include a support positioned along or substantially adjacent the transfer arm and generally can be configured to engage the sheet material from the first supply roll during feeding thereof. The sheet material from the first supply roll can be engaged between the guide roller and the support to hold the transfer arm in its first position. Further, when the sheet material from the first supply roller is dispensed and no longer positioned between the support and the guide roller, the transfer arm moves to its second position engaging the cover roller against the feed roller to facilitate feeding sheet material from the second supply roll. More specifically, movement of the transfer arm to the second feeding position allows the ends of the cover roller to move to the first end of the slots to facilitate engagement of the sheet material from the second supply roll received about the cover roller against the feed roller for feeding and dispensing thereof.

In one embodiment, the guide roller can be configured to intermesh or interleave with the support when/after the sheet material from the first supply roll is dispensed, i.e., when there is no longer sheet material from the first supply roll to be engaged between the guide roller and the support. The support can include a plurality of spaced ribs or portions with a plurality of spaces defined therebetween and along a length of the support. The guide roller also can include a plurality of spaced portions defining spaces therebetween along a length of the guide roller. The spaced portions of the guide roller generally are configured to align with the spaces in the support, while the ribs formed in the support are configured to align with the spaces in the guide roller so as to interleave or intermesh when sheet material is absent between the guide roller and the fixed support.

In one example construction, the transfer arm further can be pivotably or rotatably attached to the dispenser housing at a second end thereof. Accordingly, when/after the sheet material from the first supply roll is dispensed, the transfer arm can rotate or pivot to the second feeding position under its own weight (such as due to gravitational forces). In some constructions, however, the transfer arm can be biased towards the second feeding position by one or more biasing members that urge the transfer arm to engage the sheet material from the first supply roll between the guide roller and support, and when the first supply roll is exhausted or otherwise substantially dispensed, will bias or urge the transfer arm to its second feeding position.

Accordingly, with embodiments of the present disclosure, the transfer assembly can allow for substantially seamless transfer of feeding of sheet material between the first and second supply rolls of sheet materials, without requiring refeeding or manual manipulation of the supplies, while also preventing, reducing, or eliminating double sheet dispensing.

In one example construction, a dispenser can include a dispenser housing that at least partially supports a plurality of supplies of sheet material, and has a discharge from which sheet material from the plurality of supplies of sheet material is dispensed. The dispenser includes a feed roller rotatably connected to the dispenser housing. The feed roller has a feed roller body configured to engage and feed sheet material from one of the plurality of supplies of sheet material along a feed path a towards the discharge of the dispenser housing. The dispenser also includes a cover assembly including a cover body connected to the dispenser housing and movable between a closed position and an open position to facilitate loading of the plurality supplies of sheet material into the dispenser housing, and a roller that is rotatably connected to the cover body and configured to engage at least a portion of sheet material from one or more of the plurality of supplies of sheet material.

In addition, the dispenser includes a transfer mechanism configured to transfer feeding between the plurality of supplies of sheet material and operatively connected to the roller of the cover assembly, such that when sheet material from one of the plurality of supplies of sheet material has been substantially dispensed, the transfer mechanism facilitates movement of the roller of the cover assembly toward engagement with the feed roller body to initiate dispensing of sheet material from a different one of the plurality of supplies of sheet material.

The transfer mechanism can have a transfer arm operatively connected to the roller and movable between a plurality of feeding positions for transfer of the feeding of sheet material between the plurality of supplies of sheet material. The plurality of feeding positions can include a first feeding position in which the transfer arm holds the roller away from the feed roller body, and a second feeding position in which the transfer arm is moved to a position to enable engagement between the roller and feed roller body such that at least a portion of the sheet material from a different one of the plurality of supplies of sheet material is pressed against the feed roller body to initiate dispensing of the sheet material from the second supply.

The transfer mechanism further includes at least one guide roller that is configured to engage the sheet material from a first supply of sheet material of the plurality of supplies of sheet material, and at least one fixed support positioned substantially adjacent to the transfer arm and configured to engage the sheet material from first supply such that it is engaged between the at least one guide roller and the at least one fixed support with the transfer arm in its first feeding position.

The at least one guide roller and the at least one fixed support may be configured to intermesh when the sheet material from the first supply of sheet material is substantially dispensed to facilitate movement of the transfer mechanism from its first position towards its second position.

One or more portions of the at least one guide roller can be received within one or more spaces defined along the at least one fixed support and/or one or more portions of the at least one fixed support are positioned into one or more spaces defined along the at least one guide roller when the sheet material from the first supply is substantially dispensed and no longer present between the at least one fixed support and the at least one guide roller.

The transfer mechanism further includes one or more biasing members configured to bias the transfer arm towards its second feeding position.

The roller of the cover assembly can include at least one bearing connected thereto or formed therewith that connects the roller to the cover body, and the transfer arm can include at least one projecting portion that engages at least a portion of the at least one bearing with the transfer arm in its first feeding position.

The dispenser additionally can include a cutting assembly that is integrated with the feed roller and includes one or more cutting portions that are extensible into and out from one or more openings defined in the feed roller body.

Further, the dispenser can include an engagement portion that is operatively connected to the feed roller and configured to be actuated by a user to drive rotation of the feed roller for manual dispensing of the sheet material from the dispenser.

Still further, the dispenser can include a biasing assembly configured to assist rotation of the feed roller. The biasing assembly can include at least one biasing member connected to the feed roller body, and at least one linkage connected to the at least one biasing member and at least one portion that does not rotate with the feed roller body.

In another exemplary construction, a sheet material dispenser can include a dispenser housing within which one or more supplies of sheet material are received, and which includes a discharge from which sheet material from the one or more supplies of sheet material is dispensed. The sheet material dispenser also can include a feed roller rotatably connected to the dispenser housing and having a feed roller body configured to engage and feed the sheet material from the one or more supplies sheet material along a feed path and towards the discharge of the dispenser housing.

Additionally, the sheet material dispenser can have a sheet material loading assembly including a cover rotatably connected to at least a portion of the dispenser housing at a first end and movable between a closed position and an open position to facilitate loading of the one or more supplies of sheet material into the dispenser housing, and at least one roller that is rotatably connected to a second end of the cover. The at least one roller can be configured to receive at least a portion of sheet material from at least one supply of the one or more supplies of sheet material thereabout with the cover in its open position, and to urge the portion of sheet material toward engagement with the feed roller body, with the cover in its closed position, to initiate feeding of the sheet material from the at least one supply for dispensing from the dispenser.

The sheet material loading assembly also can have one or more biasing members coupled to the cover and operatively connected to the at least one roller so as to bias the roller toward engagement with the feed roller body when the cover is in its closed position.

The sheet material loading assembly additionally can include one or more biasing members connected to the cover and biasing the cover toward its open position, and one or more locking features configured to secure the cover in its closed position.

The at least one roller further can include sheet material retention portions that are configured to couple the portion of the sheet material to the at least one roller.

The one or more supplies of sheet material include at least first and second supplies of sheet material, and the sheet material dispenser can have a transfer assembly configured transfer feeding between the first and second supplies of sheet material.

The transfer assembly can include a transfer arm operatively connected to the at least one roller of the sheet material loading assembly and movable between a plurality of feeding positions to facilitate transfer of feeding of sheet material between the first and second supplies of sheet material. The plurality of feeding positions can include a first feeding position in which the transfer arm holds the at least one roller of the sheet material loading assembly away from the feed roller body, and a second feeding position in which the transfer arm enables engagement between the at least one roller of the sheet material loading assembly and the feed roller body such that the portion of sheet material from the first supply is pressed against the feed roller body to initiate dispensing of the sheet material from the first supply.

The transfer assembly further can include at least one guide roller that is configured to engage sheet material from second supply of sheet material, and at least one fixed support positioned substantially adjacent to the transfer arm and configured to engage the sheet material from the second supply of sheet material between the at least one guide roller and the at least one fixed support with the transfer arm in its first feeding position, wherein the at least one guide roller and the at least one fixed support are configured to intermesh when the sheet material from the second supply of sheet material is substantially dispensed to facilitate movement of the transfer arm from its first position towards its second position.

The sheet material dispenser also can have one or more pressing rollers mounted along the discharge so as to engage and direct the sheet material along the feed path as the sheet material is fed from the discharge.

The sheet material dispenser further can have a cutting assembly that is integrated with the feed roller and includes one or more cutting portions that are extensible through one or more openings defined in the feed roller body.

Further, the sheet material dispenser can have an engagement portion that is operatively connected to the feed roller and configured to be actuated by a user to drive rotation of the feed roller and control dispensing of the sheet material from the dispenser assembly.

Even further, the sheet material dispenser can have a biasing assembly configured to assist rotation of the feed roller. The biasing assembly can include at least one biasing member connected to the feed roller body, and at least one linkage connected to the at least one biasing member and at least one portion that does not rotate with the feed roller body.

Those skilled in the art will appreciate the above stated advantages and other advantages and benefits of various additional embodiments by reading the following detailed description of the embodiments with reference to the below listed drawing figures.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION

Figure 1:
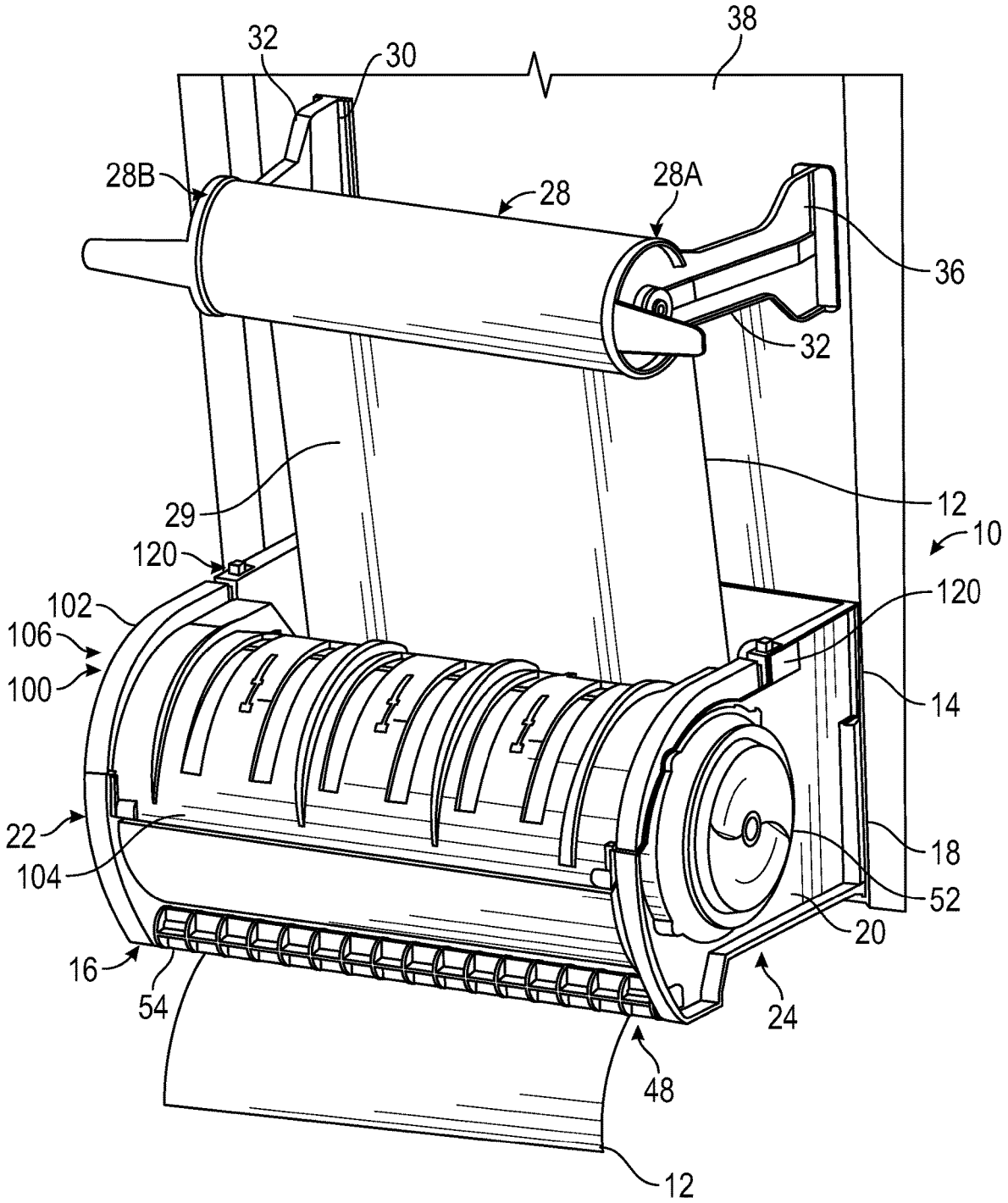
FIG. 1 is a perspective view of a dispenser assembly according to principles of the present disclosure.

FIGS. 1-9C show a dispenser assembly or dispenser 10 for a sheet material, such as for paper towels, tissue paper, other paper products, etc. and/or other suitable sheet materials. The dispenser assembly 10 has a sheet material loading system or assembly 100 to facilitate loading of supplies sheet material 12 therein, and a sheet material transfer system or mechanism 200 to facilitate the transfer feeding of sheet material between a plurality of supplies of sheet material received within or otherwise along the dispenser assembly 10.

As shown in FIGS. 1-3B, the dispenser assembly 10 can include a dispenser housing 14 having front 16, rear 18, side 20/22, and bottom 24 sides or portions. The dispenser housing 14 can be formed from a plastic material, though other suitable polymeric, synthetic, or composite materials can be used without departing from the scope of the present disclosure. The dispenser assembly 10 further at least partially supports and/or includes a plurality of supplies of sheet material, for example, two or more supply rolls of sheet material, including at least a first supply roll 26 and a second supply roll 28 supported within the dispenser housing 14. The supplies 26/28 of sheet material can include new, un-dispensed rolls of sheet material, or at least partially dispensed rolls of sheet material, e.g., including stub rolls. For example, stub rolls may include rolls with less sheet material than a full roll, and in one embodiment, a stub roll can include a full roll that has been substantially dispensed, e.g., a supply roll with less than about 50% to about 30% or less of its initial/starting amount of sheet material remaining. It also will be understood that, while two supply rolls 26/28 are shown in FIGS. 1A-2B, a greater number of supply rolls, such as 3 or more supply rolls, can be used without departing from the scope of the present disclosure.

Figure 3A:
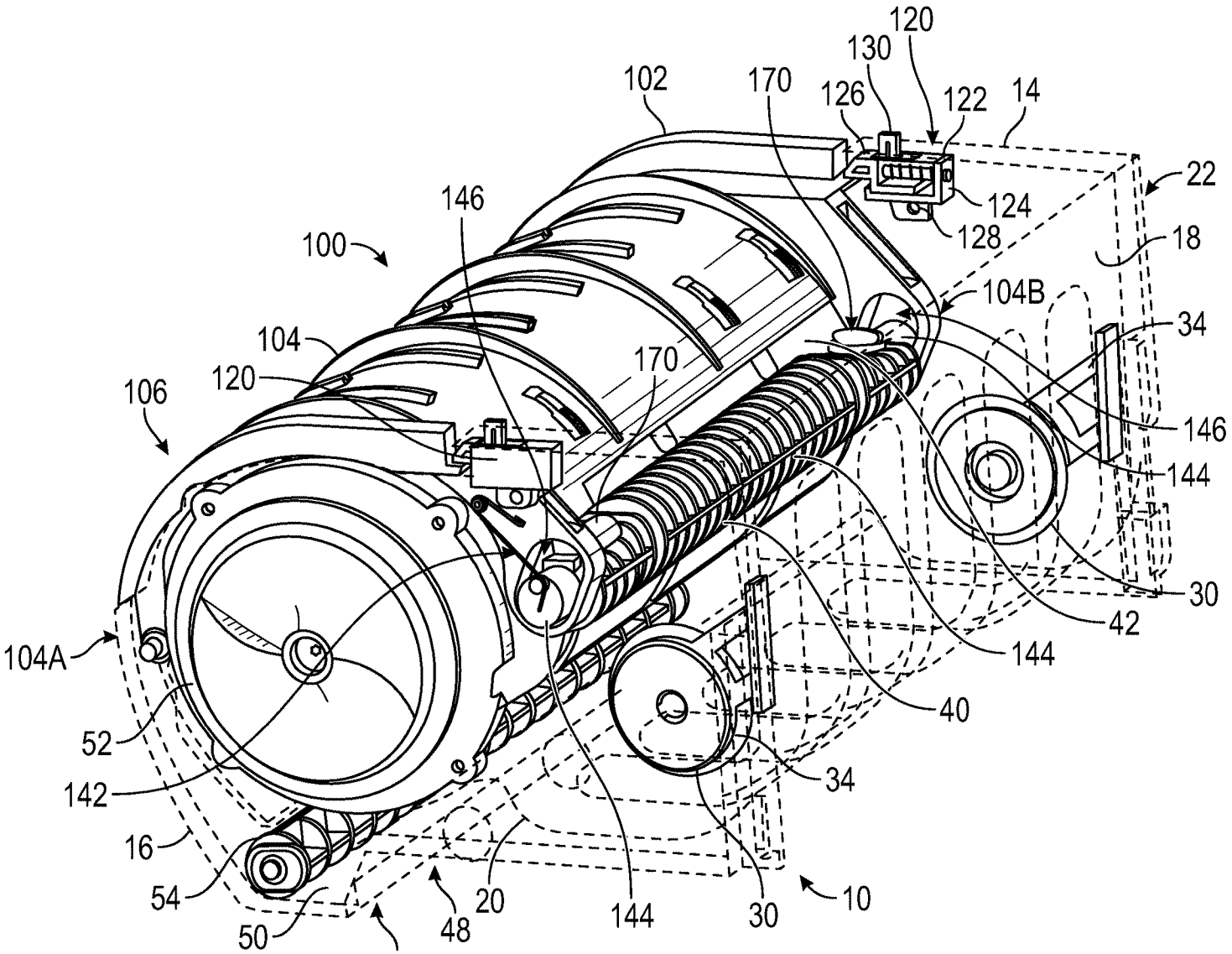
FIGS. 3A and 3B are perspective views of the dispenser assembly of FIG. 1, with a cover assembly in a closed position, and showing portions of the dispenser removed for clarity of illustration in accordance with the present disclosure.
Figure 3B:
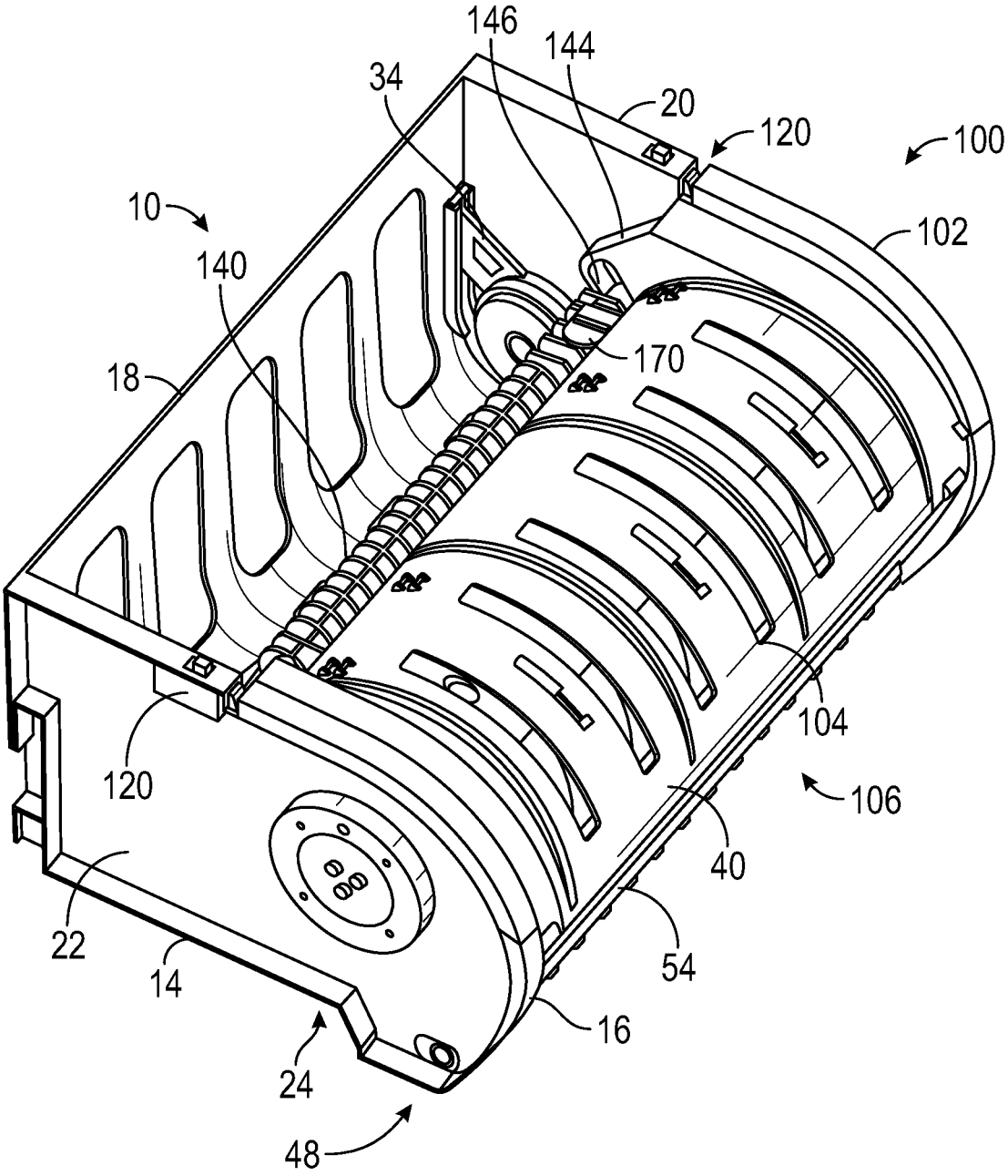

The supply rolls 28 and 26 are rotatably coupled to the dispenser housing 14, by opposing supports 30/32 (FIGS. 1 and 3A). As shown in FIGS. 1 and 3A, the supports 30/32 can include one or more arms 34/36 connected to the dispenser housing 14, and which can be rotatably coupled to the ends 28A/B and 26A/B of the supply rolls 28/26, so that the supply rolls 28/26 of sheet material can substantially freely rotate with respect to the arms 34 and 36 as the sheet material is pulled therefrom during dispensing. The supply rolls 28/26 also may be otherwise rotatably or movably mounted to or along the dispenser housing 14 without departing from the scope of the present disclosure. In one construction, the arms 34 can be coupled to the rear portion 18 of the dispenser housing 14 (FIG. 3A), and the arms 36 can be connected to a backing plate 38 attached to or formed with the rear portion 18 of the dispenser housing 14 (FIG. 1).

Additionally, as shown in FIGS. 2A-3B and 7A-9C, the dispenser assembly 10 also generally includes one or more feed rollers 40 rotatably mounted therein. The one or more feed rollers 40 can be rotatably connected to the dispenser housing 14. The feed roller (or rollers) 40 includes a feed roller body 42, e.g., formed from a plastic material, though other suitable polymeric, synthetic, or composite materials may be used without departing from the scope of the present disclosure. The feed roller body 42 further can include a plurality of spaced gripping bands 44 (e.g., formed from polymeric or other suitable synthetic or composite materials) applied thereabout. The feed roller(s) 40 is operable to rotate or pull and guide or feed the sheet material 12 along a feed or discharge path 46 towards a discharge, such as a discharge chute 48, of the dispenser 10 for dispensing or distribution of an amount or length of the sheet material to a user. The discharge chute 48 can comprise a discharge opening or slot 50 arranged along the bottom portion 24 of the dispenser housing 14, as illustrated in FIGS. 3A, 7A and 8A-8B.

A portion of the sheet material 27 or 29 from the first 26 or second 28 supply rolls will be at least partially disposed about and in engagement or contact with the feed roller 40, such that, upon rotation of the feed roller 40 the sheet material 27 or 29 from the first 26 or second supply rolls 28 will be pulled, causing the supply rolls 26/28 to be rotated and an amount or length of sheet material 12 to thus be fed to and through the discharge chute 48. The feed roller 40 can have a diameter selected for feeding a prescribed or predetermined or known length or amount of sheet material. For example, the feed roll 40 can have a diameter or size selected to feed a 6", 8", 10", 12", 14", 16", etc. (or other integer or non-integer numbers therebetween and/or other suitable predetermined lengths) of sheet material for each revolution or series of revolutions of the feed roller.

In one construction, the feed roller 40 can be manually driven. For example, as shown in FIG. 1-3A, the dispenser assembly 10 can include an engagement portion 52, such as a lever, knob, or other suitable engagement portion, that is operatively connector to or otherwise in communication with the feed roller 40, and which engagement portion 52 is configured to be actuated or turned by a user to drive movement/rotation of the feed roller 40 and thus control dispensing of the sheet material. Users further can engage and pull portions of the sheet material hanging from or in (e.g., hanging tabs) the discharge chute 48 for dispensing of sheet material.

Additionally, or in alternative constructions, the feed roller 40 can be automatically driven by a drive mechanism (e.g., including a motor) that activates when one or more sensors detect a predetermined condition. For example, when a sensor, such as an infrared sensor or other similar type of sensor, detects the presence of a user's hand in front of, adjacent, or below the dispenser housing 14, or detects the presence or absence of sheet material extending from the discharge chute 44. U.S. patent application Ser. Nos. 15/173,970, 15/185,776, and 15/185,937, which are specifically incorporated by reference herein as if set forth in their entireties, show example arrangements of other drive mechanisms for driving the feed roller. However, any suitable driving mechanism, arrangement, or configuration can be employed to drive rotation of the feed roller 40 for feeding or dispensing sheet material, without departing from the scope of the present disclosure. The drive mechanism further can be activated when a user activates the engagement portion or pulls a hanging tab to provide drive assisted dispensing of sheet material.

FIGS. 1, 2B, and 3A-3B further show that the dispenser assembly 10 can include one or more guide or pressing rollers 54 mounted along or substantially adjacent the discharge 48. Such as guide or pressing roller (or rollers) 54 located in a position so as to define a nip and that contact or otherwise engage and direct the sheet material 12 along a feed path toward the discharge chute as the sheet material is fed from the discharge 48 for dispensing from the dispenser 10. In one embodiment, the guide roller(s) 54 can be biased, such as by one or more springs or other suitable biasing members to contact and engage the sheet material between the guide roller(s) and a portion of the discharge 48. However, the guide roller(s) can be unbiased, without departing from the scope of the present disclosure.

The dispenser assembly 10 additionally includes a sheet material loading assembly or system 100 as generally shown in FIGS. 1-8B. The sheet material loading mechanism/assembly 100 can include a cover assembly 102 that is movably connected to the dispenser housing 14. The cover assembly 102 includes a cover body 104 that is rotatably or pivotably coupled to the front portion 16 of the dispenser housing 14, e.g., at a first end 104A of the cover body 104, such that the cover body 104 is movable between a closed position 106 and an open position 108. In the closed position 106, the cover body 104 will at least partially surround and/or at least partially enclose the feed roller 40, and in the open position 108, the cover body 104 generally will be substantially spaced away or displaced from the feed roller 40, e.g., with the cover body extending out and away from the front portion 16 of the dispenser housing 14.

Figure 4A:
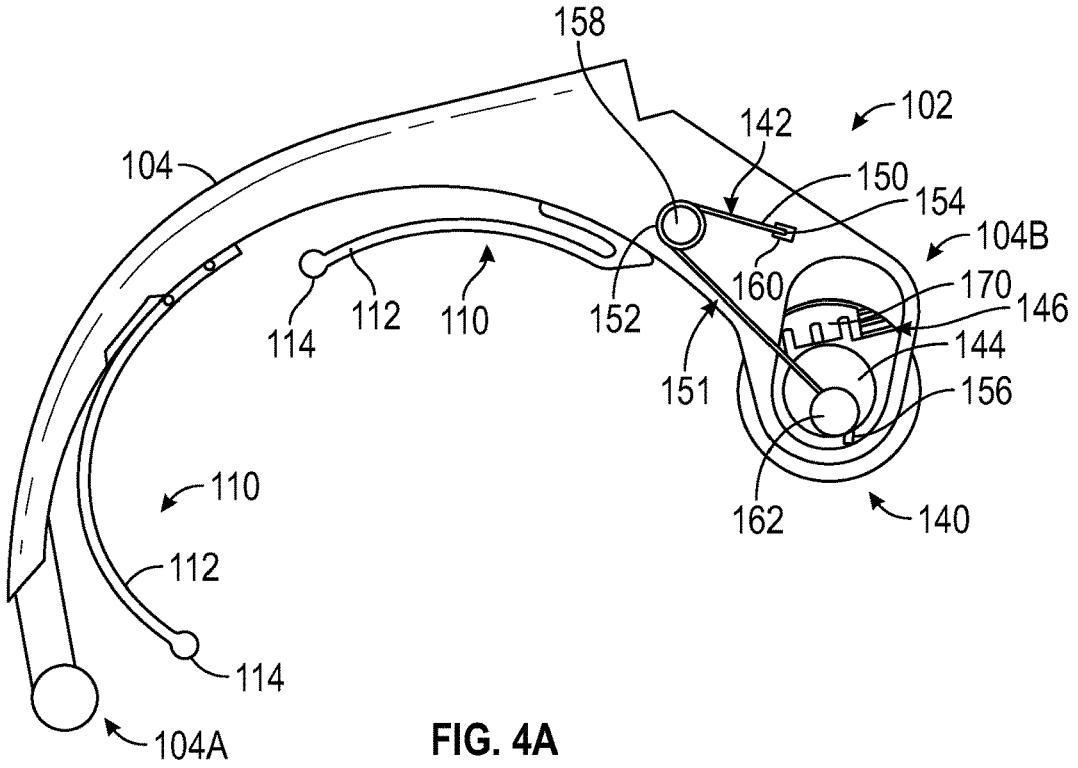
FIGS. 4A, 4B, and 4C show cross-sectional, perspective, and partial views of the cover assembly for the dispenser assembly of FIG. 1 according to principles of the present disclosure.
Figure 4B:
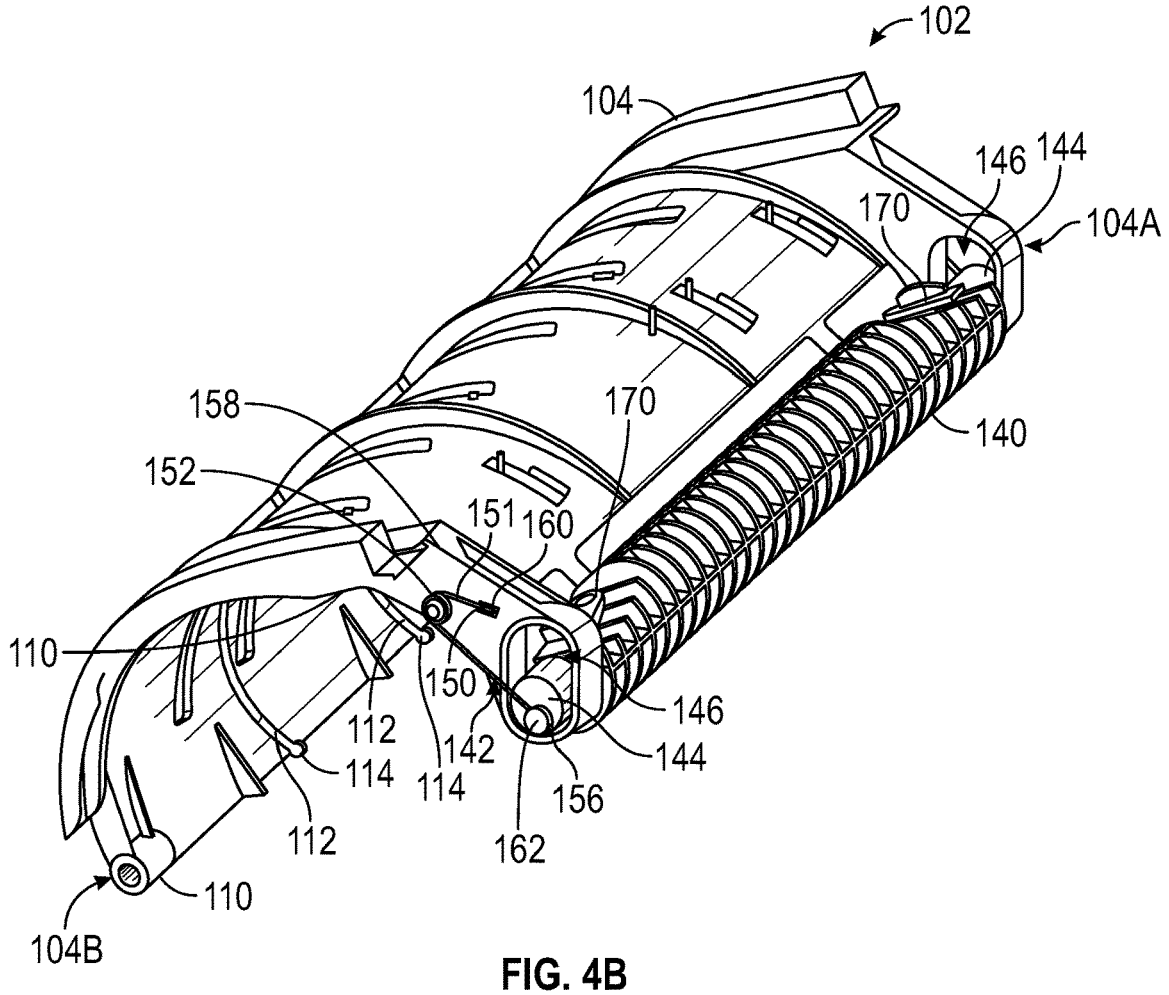

In one embodiment, the cover body 104 has one or more generally arcuate or curved portions or sections that generally follow or conform to the shape of the feed roller 40, though other shapes or constructions can be employed without departing from the scope of the present disclosure. The cover body 104 further can be formed from a plastic material, though other polymeric, synthetic, or composite materials are possible in accordance with the present disclosure. FIGS. 4A-4B further indicate that the cover body 104 can have sheet material guide or engagement fingers 110 formed with or attached thereto. In one example embodiment, the guide fingers 110 can have an elongated body 112 with an engagement portion 114, such as having a spherical or other suitable shape, at one end thereof and configured to engage the sheet material against the feed roller body 42, as generally indicated in FIGS. 4A-4B.

As additionally illustrated in FIGS. 1-8B, the sheet material loading assembly 100 includes one or more locking features or mechanisms 120 configured to lock or secure the cover assembly 102 in its closed position 106. In one embodiment, the locking features 120 can include switch assemblies 122 having a bracket 124 coupled to the dispenser housing 14 and supporting a biased switch member 126. The biased switch member 126 can be biased by a biasing member 128, such as a spring or other suitable biasing member, so as to be urged towards an extended position to facilitate locking or securing of the cover assembly 102, and a retracted position that allows for release of the cover assembly 102 in its movement to the open position 108. The switch members 126 can engage and hold a portion of the cover body 104 to hold the cover assembly 102 in the closed position 106, and further can include a tab or engagement portion 130 that will be engaged by an operator to move the switch members 126 along the brackets 124 to their retracted position for release of the cover assembly 102.

Figure 7A:
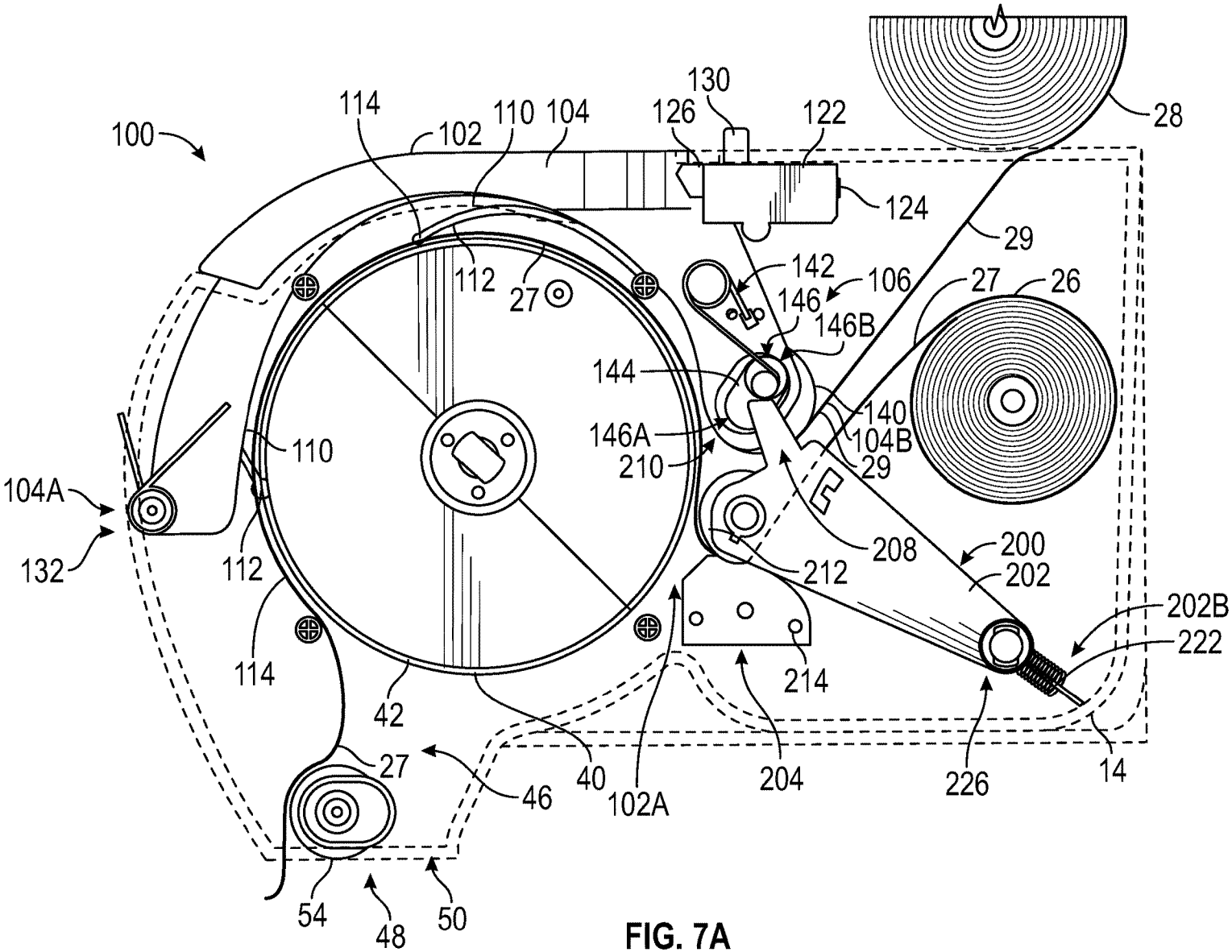
FIGS. 7A and 7B show cross-sectional views of the dispenser assembly of FIG. 1, with a stub roller transfer assembly in a first position in accordance with the present disclosure.
Figure 8A:
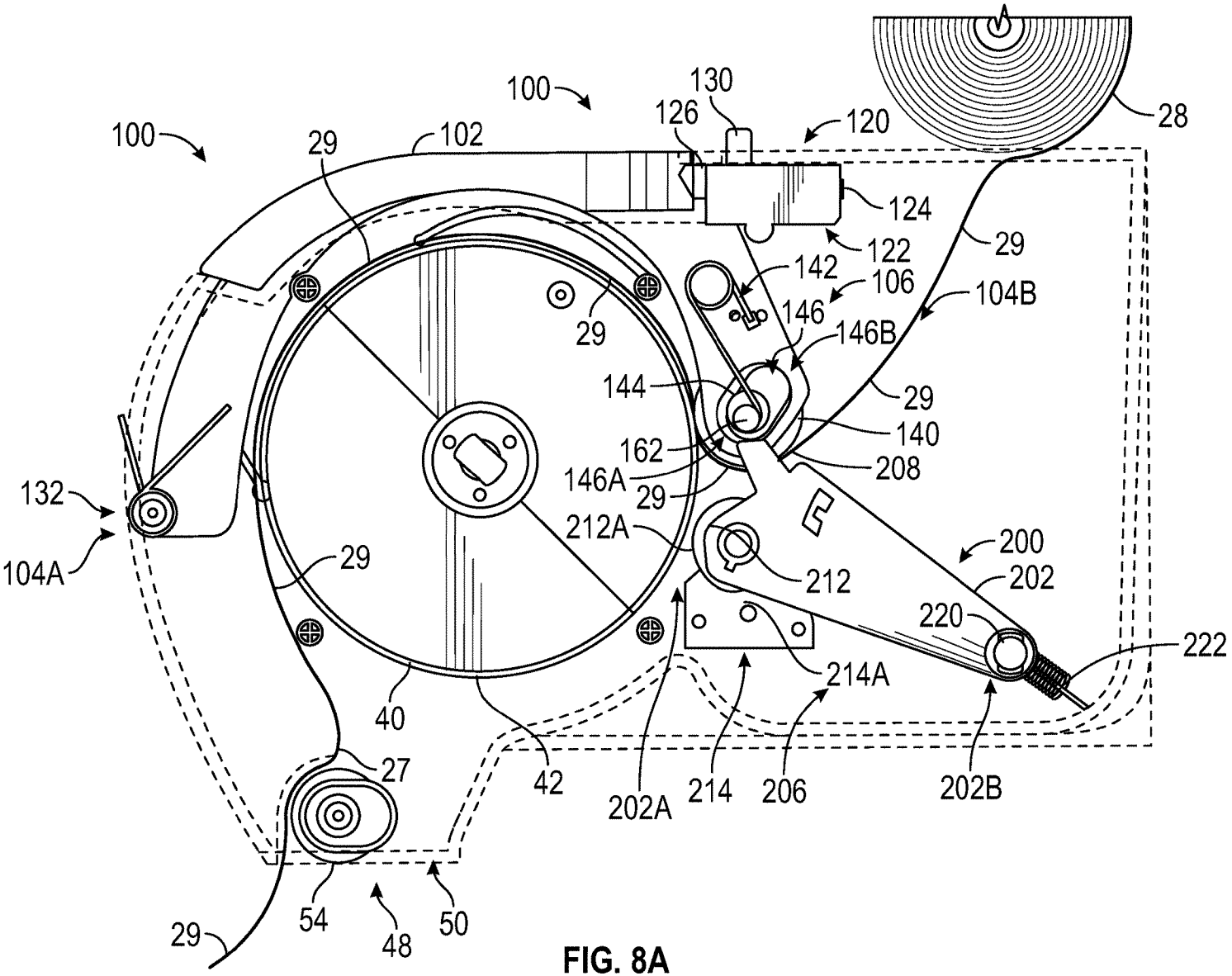
FIGS. 8A and 8B show cross-sectional views of the dispenser assembly of FIG. 1, with a stub roller transfer assembly in a second position in accordance with the present disclosure.
Figure 8B:
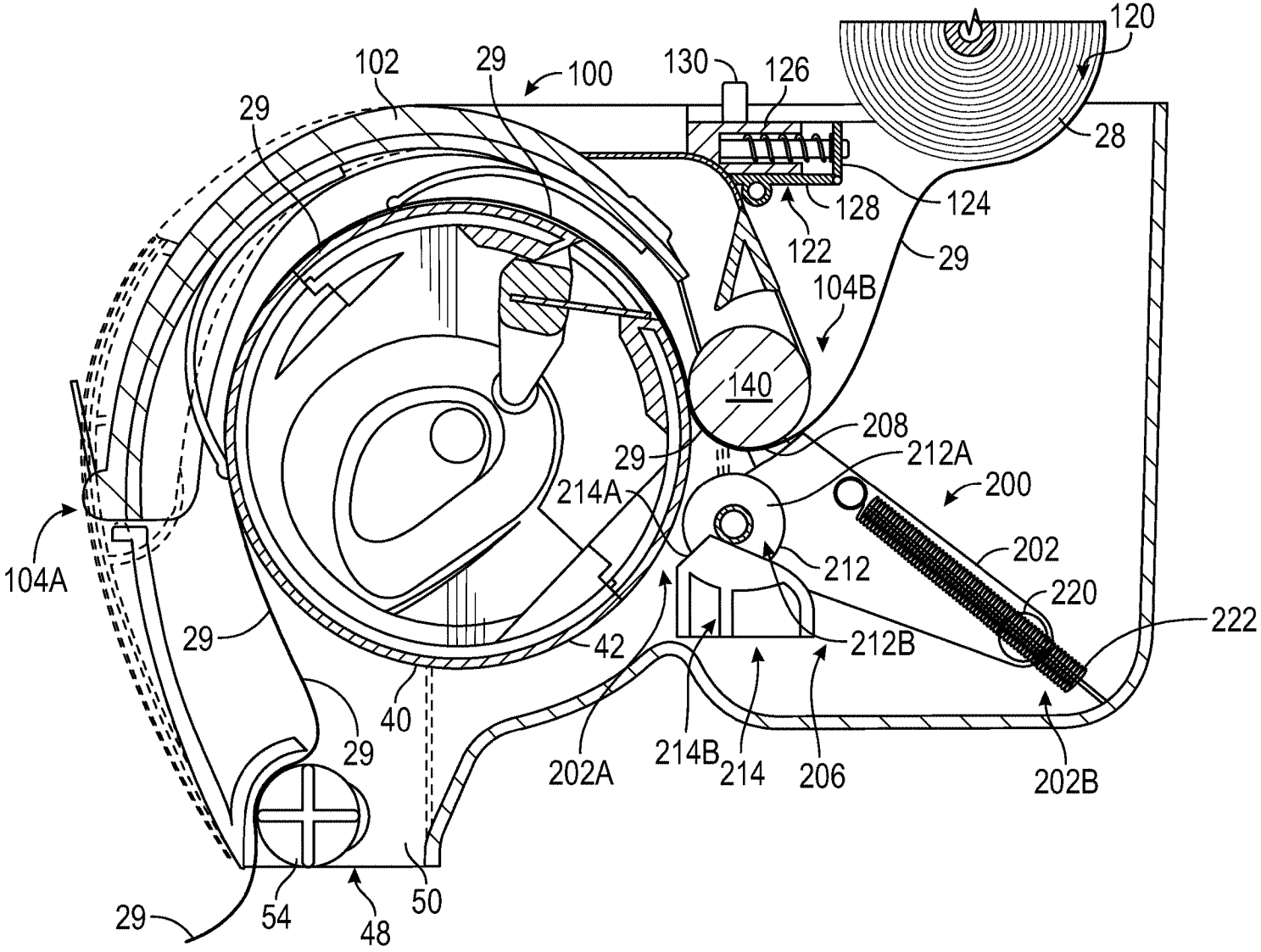

FIGS. 7A and 8A further show the cover assembly 102 to be biased towards its open position 108, such as by one or more biasing members 132. In one embodiment, the biasing members 132 can include one or more springs, such as torsion springs, or other suitable biasing members that engage the cover body 104 to bias the cover assembly 102 towards its open position 108. In addition, with the cover assembly 102 secured in its closed position 106, the cover assembly 102 can be urged towards its open position 106 by the biasing members 132. In this regard, the cover assembly 102 is moved to its open position upon release or unlocking of the switch members 126 (i.e., when switch members 126 are moved to their retracted position).

Additionally, the cover assembly 102 includes a cover roller 140, which can include a guide or pressing roller, connected to the cover body 104. For example, as shown in FIGS. 2A-2B, 3A-3B, 4A-4C, 7A-7B, and 8A-8B, the cover roller 140 can be rotatably connected to the cover body 104 at the second end 104B thereof, and can be biased or urged, e.g., by one or more springs or other biasing members 142, so as to press or engage at least a portion of the sheet material against the feed roller body 42, when the cover assembly 102 is in its closed position 106. The cover roller 140 can define a nip along the feed roller body 42. The cover assembly 102 also includes end bearings or bearing portions 144 that can be connected to or formed with the cover roller 140, and that support or connected the cover roller 140 to the cover body 104. The bearings 144 are received within slots 146 or other openings defined along/in the second end 104B of the cover body 104. The cover roller 140 further is movable along the slots 146, e.g., under the control/urging of biasing member(s) 142, which can be coupled to the cover body 104 and can engage the bearings 144 of the cover roller 140 to urge the cover roller 140 towards and into engagement with the feed roller body 42, e.g., towards a first end 146A of the slots 146 defined in the cover body 104.

Figure 4C:
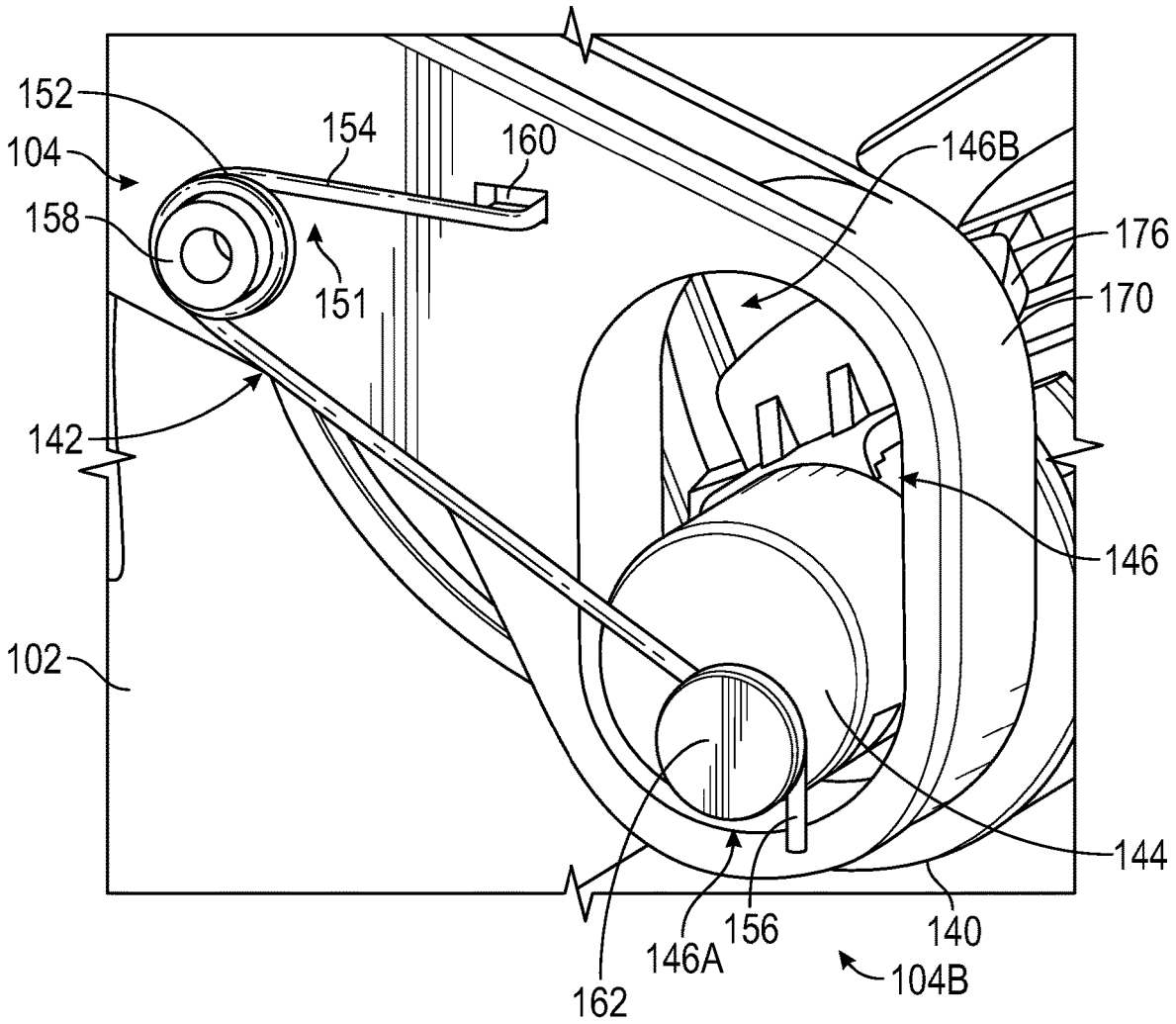

In one embodiment, as generally shown in FIGS. 4A-4C, the biasing member(s) 142 can include a torsion spring 150 with a body 151 having a coiled loop portion 152, as well as a first and second free ends 154/156. The coiled loop portion 152 is received about a projection 158 formed along the cover body 104 to couple the torsion spring 150 thereto. The first free end 154 of the torsion spring 150 can engage a notch or opening 160 in the cover body 104, and the second free end 156 of the torsion spring 150 can engage a projecting portion 162 formed with or otherwise connected to the bearing portions 144 of the cover roller 140. Thus, the spring 150 will urge the bearing portions towards the first end 146A in the slot 146 and thereby engage the cover roller 140 against the feed roller body 40, with the cover assembly 102 in its closed position 106.

FIGS. 2A-2B, 3A-3B, 4A-4C, and 5 also indicate that the cover roller 140 additionally can include one or more sheet material retention portions or features 170, such as clips, sharpened portions, gripping areas, etc., configured to substantially secure or otherwise couple the sheet material to the cover roller 140 to facilitate loading of the sheet material in the dispenser assembly 10. With the cover assembly 102 in its open position 108, an operator can connect/engage a portion of the sheet material from the first or second supply rolls 26/28 of sheet material with the sheet material retention features 170 to secure or otherwise couple the portion of the sheet material 12 about the cover roller 140.

Figure 5:
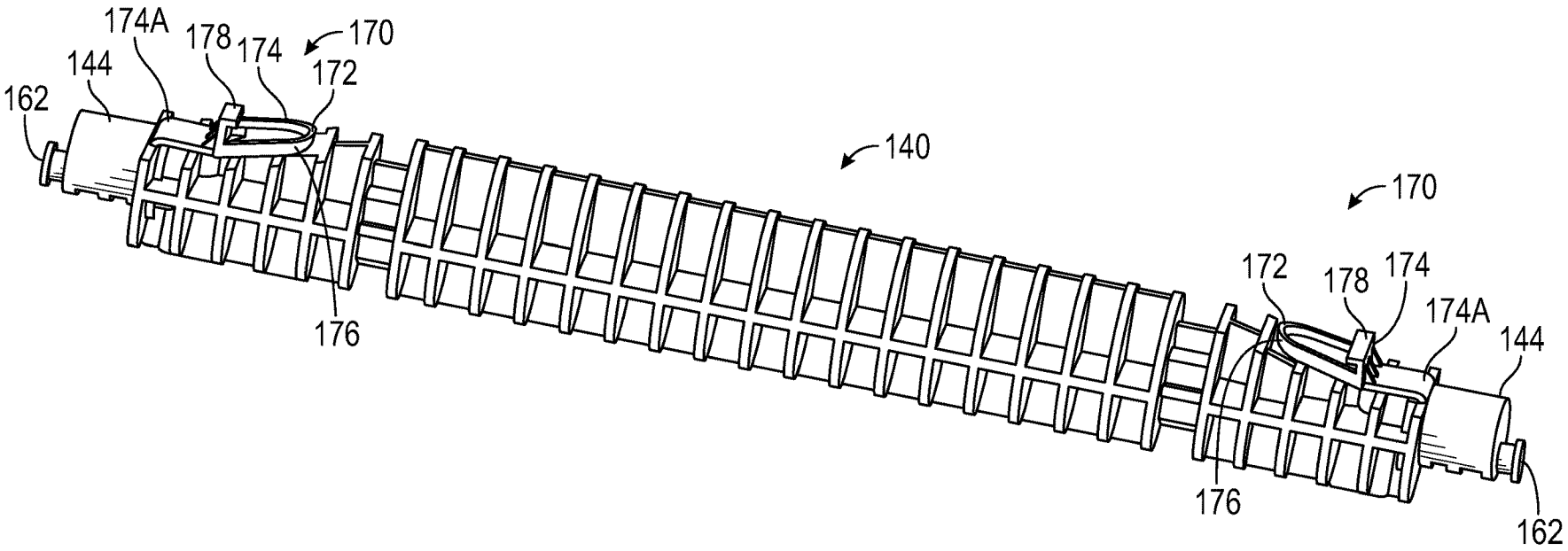
FIG. 5 is a perspective view of an embodiment of a cover roller for the cover assembly shown in FIGS. 4A-4C.

In one embodiment, as indicated in FIG. 5, the retention features 170 can include biased clips 172 that engage the sheet material 12 against the cover roller 140. The clips 172 each can include a clip body 174 connected to the cover roller 140 at one end 174A, such that the clip body 174 is pressed or engaged against an outer surface 176 of the cover roller 140, and a projecting portion 178 can be engaged by an operator to move the clip body 174 away from the cover roller 140 as needed, such as to allow the sheet material to be inserted and/or positioned between the clip body 174 and the outer surface 176 of the cover roller 140. With the sheet material positioned between the projecting portions 178 the clip body 174 and the outer surface 176 of the cover roller 140, the clip body 174 presses or engages the sheet material against the outer surface 176 of the cover roller 140 to couple the sheet material thereto.

Figure 6A:
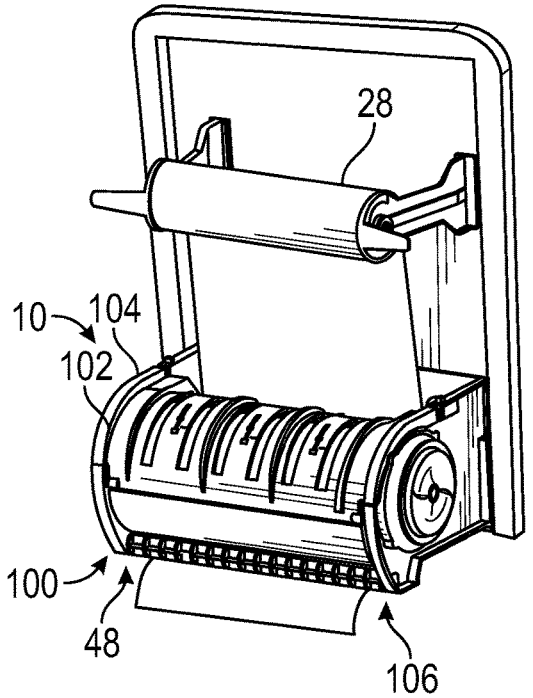
FIGS. 6A-D show a series of views illustrating an example embodiment of the loading of the dispenser assembly of FIG. 1 according to principles of the present disclosure.
Figure 6B:
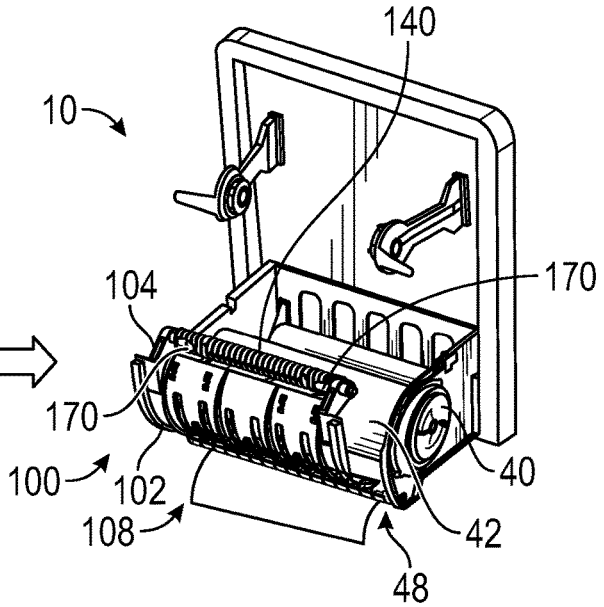
Figure 6D:
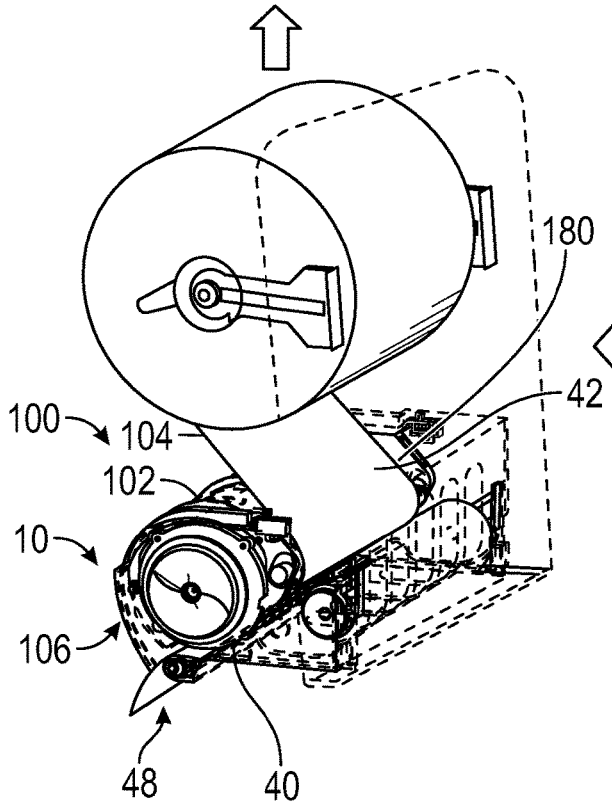
Figure 6C:
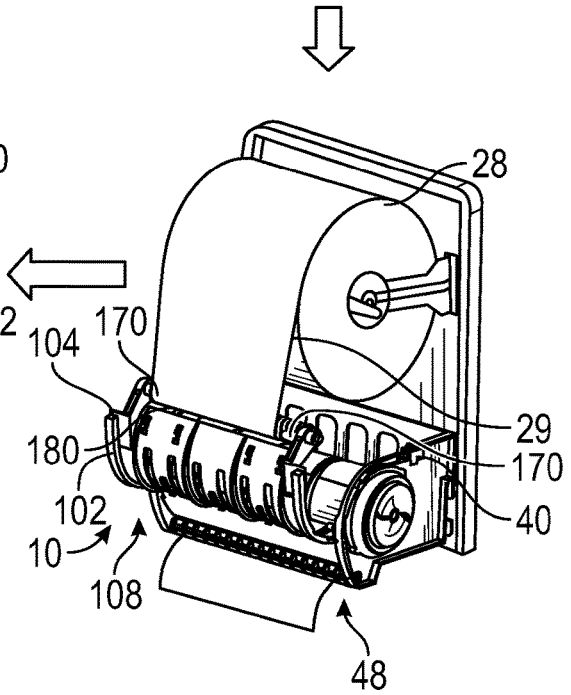

FIGS. 6A-6D show schematic diagrams for loading of the dispenser assembly 10 according to principles of the present disclosure. In particular, FIGS. 6A-6B show that after one of the supply rolls, e.g., supply roll 28, has been substantially dispensed (FIG. 6A), the supply roll can be removed. In some embodiments, this substantially dispensed supply of sheet material can be moved to a stub roll position, e.g., it can be substituted for and/or it can become the first supply roll 26. As indicated in FIG. 6C, a new, un-dispensed supply roll, can be loaded into the dispenser assembly 10, into the position of supply roll 28, and an end portion 180 of the sheet material 29 can be engaged with the retention features 170 to engage the sheet material 29 about/along the cover roller 140. Thereafter, as shown in FIG. 6D, the cover assembly 102 can be moved to its closed position 106, such that the cover roller 140 engages or presses the sheet material against the feed roller body 42. As a result, upon automatic or manual actuation of the feed roller 140, the sheet material can be engaged and urged along the discharge path 46 and toward and through the discharge 48 of the dispenser housing 14. Accordingly, with embodiments of the present disclosure, operators generally do not have to struggle to load the sheet material through tight clearances in the dispenser assembly, as with traditional dispensers.

FIGS. 7A-8B additionally show that the dispenser assembly 10 also can include a supply roll transfer assembly or mechanism 200 that facilitates transfer of feeding between the first 26 and second 28 supply rolls. The supply roll transfer assembly 200 is operatively connected to or is otherwise in operative communication with the cover roller 140. When sheet material from one of the supplies of sheet material, e.g., the first supply roll 26 or the second supply roll 28, has been substantially dispensed, the supply roll transfer assembly 200 facilitates and/or allows movement of the cover roller 140 (and sheet material engaged therewith or extending thereabout) toward engagement with the feed roller body 42 to initiate dispensing of the sheet material from another supply of sheet material, e.g., enabling dispensing from the second supply roll 28 when the first supply roll has been substantially exhausted, or from the first supply roll 26 after the second supply roll has been substantially exhausted.

In the illustrated embodiment, as shown in FIGS. 7A-8B, the transfer assembly 200 includes a transfer arm or other portion 202 that is movable between a plurality of feeding positions to facilitate transfer of feeding of sheet material between the first 26 and second 28 supply rolls—e.g., the transfer arm 202 is movable between a first feeding position 204 for feeding sheet material from one supply roll, and a second feeding position 206 for feeding sheet material from another supply roll.

In particular, the transfer arm 202 is operatively connected to or otherwise in operative communication with the cover roller 140. In the first feeding position 204, the transfer arm 202 is positioned or configured to substantially maintain the cover roller 140 (and sheet material connected thereto) in a position spaced away from the feed roller body 42. In the second feeding position 206, the transfer arm 202 is positioned or otherwise configured to allow engagement between the cover roller 140 (and sheet material connected thereto) and the feed roller body 42, i.e., such that sheet material connected to or engaged by the cover roller 140 is pressed against the feed roller body 42. As a result, sheet material 27 from the first supply roll 26 will be fed with the transfer arm 202 in its first feeding position 204, and sheet material 29 from the second supply roll 28 will be fed with the transfer arm 202 in its second feeding position 206, though these positions can be reversed without departing from the scope of the present disclosure. To load the sheet material with the transfer arm 202 in the first feeding position 204, sheet material from the first supply roll 26 can be engaged with the feed roller 40, and sheet material from the second supply roll 28 can be engaged with the cover roller 140 (e.g., via retention features 170).

In the first feeding position 204, as indicated in FIGS. 7A-8B, transfer arm 202 can engage a portion of the cover roller 140 connected to the cover assembly 102, such that the cover roller 140 (and the sheet material from the second supply roll 28 received thereabout) is positioned substantially apart or substantially spaced away from the feed roller body 42, e.g., to define a sufficient gap or space 210 between the cover roller 140 and the feed roller body 142. In one construction, the transfer arm 202 can include a projecting portion or flange 208 that engages or presses against the bearing portion 144 of the cover roller 140 to press the bearing portion 144 against or to urge the bearing portion 144 towards the second end 146B of the slots 146, with the cover roller 140 spaced away from (i.e., the gap or space 210 between) the feed roller body 42. In one embodiment, the cover roller 140 can be spaced about 2.5 mm to about 3.5 mm from the feed roller body 42, though the cover roller 140 can be spaced less than about 2.5 mm or more than about 3.5 mm from the feed roller body 42 without departing from the scope of the present disclosure.

FIGS. 7A-8B further shows the transfer arm 202 including a guide roller 212 rotatably attached to a first end 202A of the transfer arm 202 and configured to engage and guide the sheet material 27 from the first supply roll 26, with the transfer arm 202 in the first position 204 (i.e., when the dispenser assembly 10 is feeding sheet material from the first supply roll 26). For example, the guide roller 212 can engage and direct the sheet material 27 from the first supply roll 26 so that it is engaged and driven by the feed roller body 42 along the discharge path 46 through the discharge 48.

The transfer assembly 200 additionally includes a fixed support or elongated body 214 positioned along or substantially adjacent to the transfer arm 202 as generally indicated in FIGS. 7A-8B. The fixed support 214 generally is configured to engage the sheet material from 27 the first supply roll 26 during feeding thereof, such that the sheet material 27 from the first supply roll 26 is engaged between the guide roller 212 and the fixed support 214 holding the transfer arm 202 in its first feeding position 204 (FIGS. 7A-7B). When the sheet material from the first supply roller 26 is dispensed and no further sheet material therefrom is received between/engaged by the fixed support 214 and the guide roller 212, the transfer arm 202 will move to its second position 206 such that cover roller 140 is engaged against the feed roller body 42 to facilitate feeding of the sheet material 29 from the second supply roll 28. More specifically, movement of the transfer arm to its second feeding position 206 allows the bearing portions 144 of the cover roller 140 to be moved to the first end 146A of the slots 146, e.g., under urging or force of the biasing members 142 connected to the cover roller 140, to facilitate engagement of the sheet material 29 from the first supply roll 26 received about the cover roller 140 against the feed roller body 42 for dispensing thereof.

The guide roller 212 and the fixed support 214 are configured to interact, e.g., the guide roller 212 moves in relation to the fixed support 214, to facilitate movement of the transfer arm 202 from its first position 204 to its second position 206. In one construction, the guide roller 212 can be configured to intermesh or interleave with the fixed support 214 when/after the sheet material 27 from the first supply roll 26 is dispensed, i.e., there no longer is sheet material 27 engaged between the guide roller 212 and the fixed support 214. In this regard, the fixed support 214 can include a plurality of spaced ribs or portions 214A with a plurality of spaces 214B defined therebetween and arranged along a length of the fixed support 214. The guide roller 212 also can include a plurality of spaced ribs or portions 212A defining spaces 212B therebetween and arranged along a length of the guide roller 212. The spaced portions 212A of the guide roller 212 are configured to align with the spaces 214B in the fixed support 214, and the spaced portions 214A in the fixed support 214 are configured to align with the spaces 212B in the guide roller 212. Accordingly, the spaced portions 214A of the fixed support 214 and spaced portions 212A of the guide roller 212 can intermesh or interleave when sheet material is not present therebetween. More specifically, when sheet material is not present between the guide roller 212 and the fixed support 214, the spaced portions 214A of the fixed support 214 and spaced portions 212A of the guide roller 212 are positioned into the corresponding spaces 214B and 212B of the fixed support 214 and guide roller 212.

FIGS. 7A-8B further show that the transfer arm 202 is pivotably or rotatably attached (e.g., at pivoting or rotating connection 220) to the dispenser housing 14 at a second end 202B thereof. As such, when/after the sheet material 27 from the first supply roll 26 is dispensed, the transfer arm 202 can rotate or pivot to the second feeding position 206. In some constructions, as indicated in FIGS. 7A-8B, the transfer arm 202 can be biased towards its second feeding position 206, e.g., by one or more biasing members 222, such as tension springs or other biasing member coupled to the transfer arm 202. The biasing members 222 can bias or urge the transfer arm 202 toward a position to engage the sheet material 27 from the first supply roll 26 between the guide roller 212 and fixed support 214 in the dispensing positon 204, and when the first supply roll 26 is exhausted/substantially dispensed, can bias or urge the transfer arm 202 forward its second feeding position 206.

Accordingly, with embodiments of the present disclosure, the transfer assembly 200 can allow for substantially seamless transfer of feeding of sheet material between the first supply roll 26 and the second supply roll 28 of sheet materials, without requiring refeeding or manual manipulation of the supplies, while also avoiding double sheet dispensing.

Figure 7B:
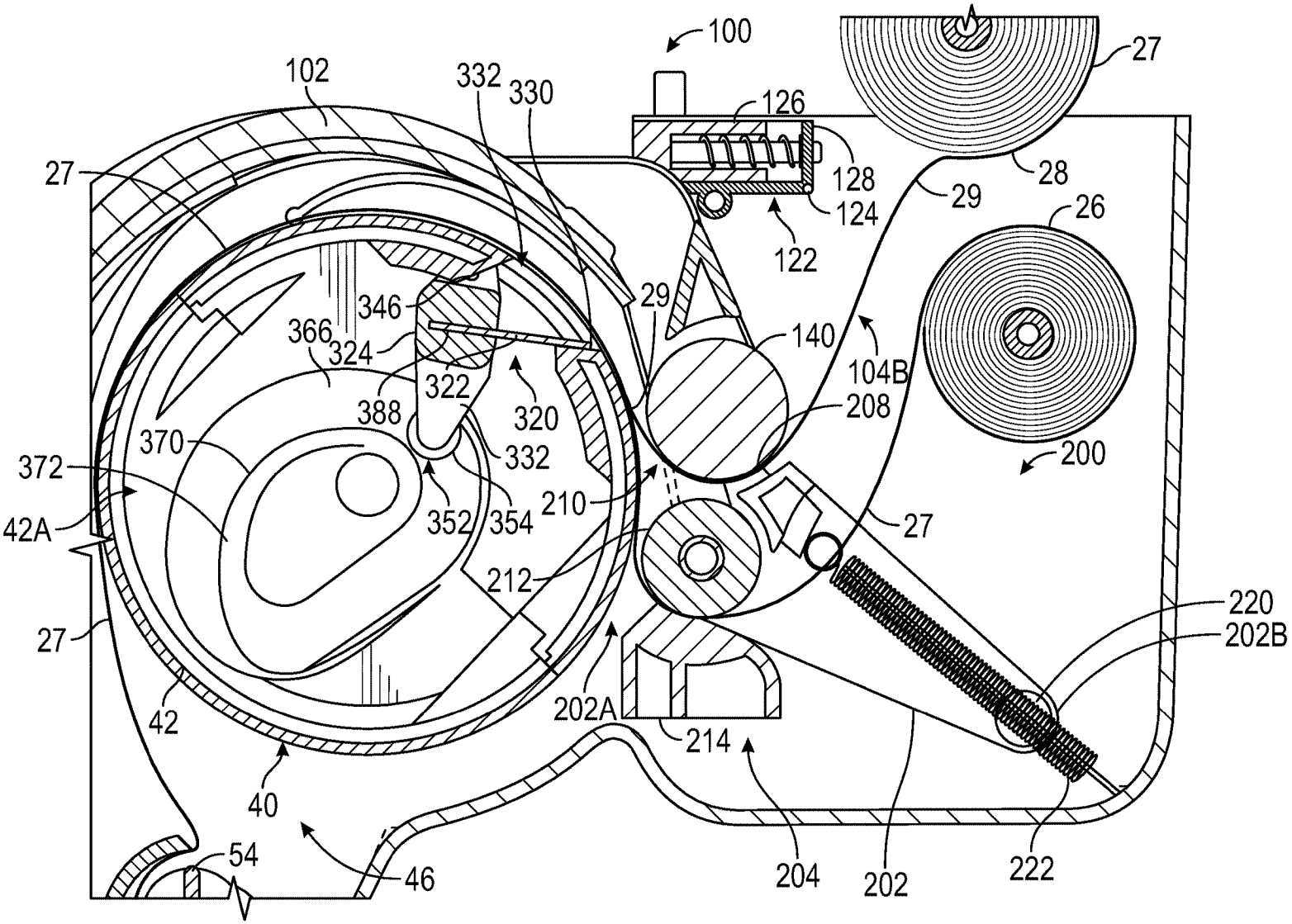
Figure 9A:
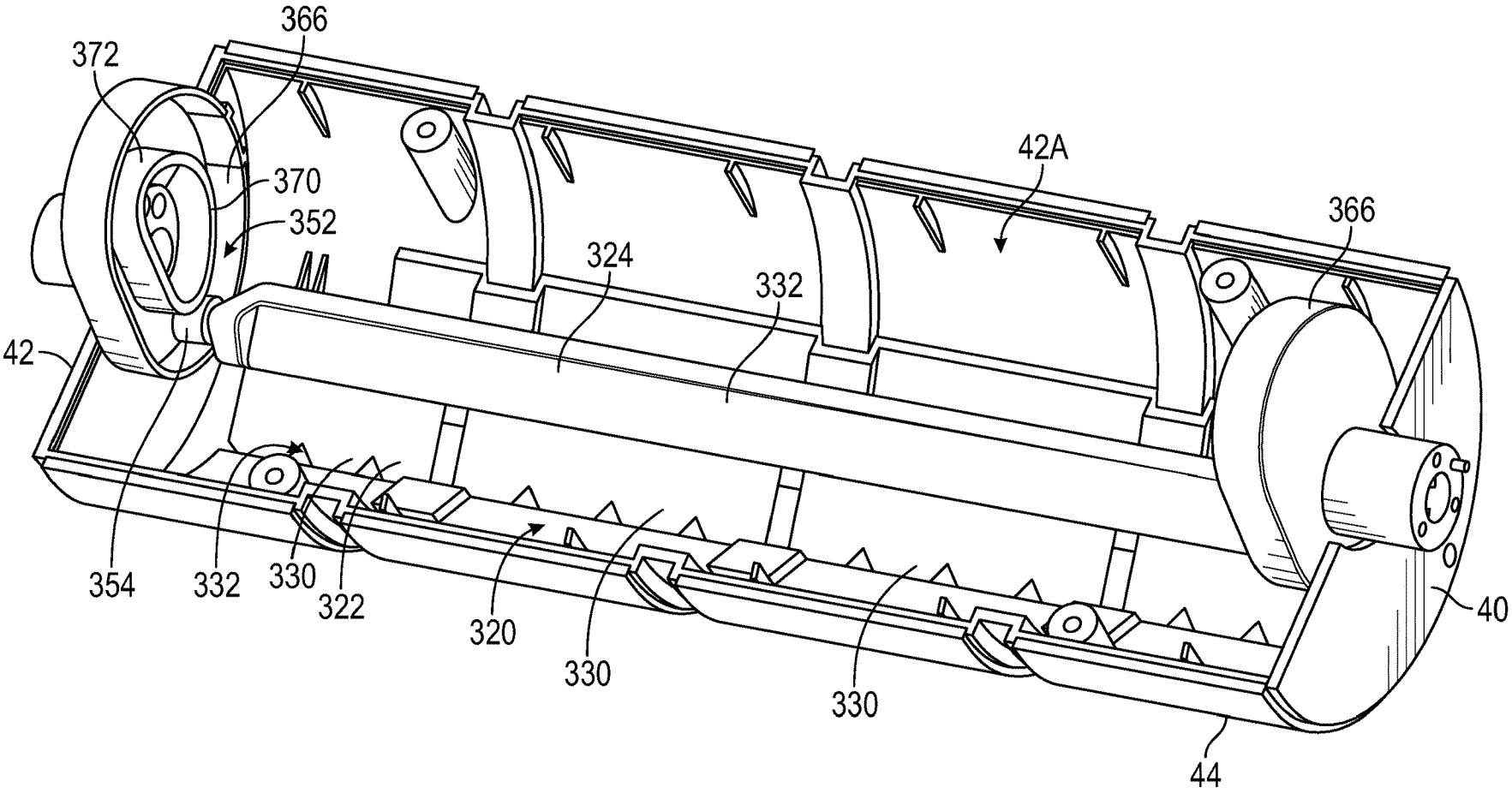
FIGS. 9A, 9B, and 9C show partial views of embodiments of a feed roller for the dispenser assembly of FIG. 1 according to principles of the present disclosure.

FIGS. 7A, 7B, and 9A show a cutting assembly or system 320 that is integrated with the feed roller 40. The cutting assembly 320 can include a cutting blade 322 and a base or support 324 connected to and at least partially supporting the cutting blade 322. The base 324 can be pivotably or otherwise movably mounted within a cavity or chamber 42A defined within the feed roller body 42, such that teeth or sharpened portions 330 of the cutting blade 322 are extensible from the feed roller body, moving between extended and retracted positions out of and back through an opening or slot 332 defined along the feed roller 40 by movement of the base 324.

The base 324 will have a body 332 that can be formed from a plastic material or other polymeric material, though other suitable materials, such as rubber, wood, composites, etc., also can be used without departing from the scope of the present disclosure. The base 324 generally will be coupled or connected to the cutting blade 322 along a portion 338 of the base 324, such as by a series of fasteners, e.g. screws, bolts, rivets, etc., though the cutting blade can be otherwise fixed to or integrated with the support/base, without departing from the scope of the present disclosure.

Figure 2A:
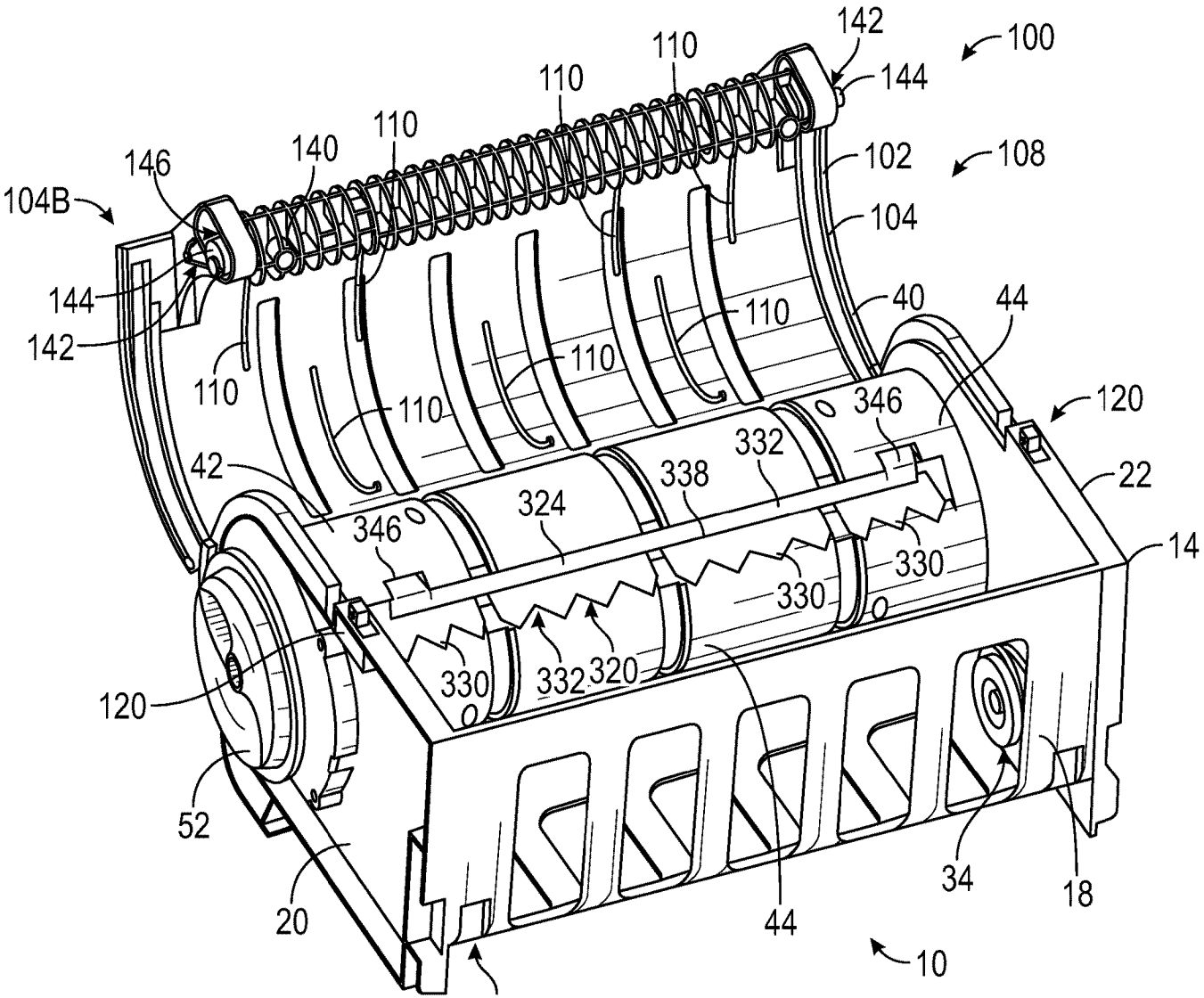
FIGS. 2A and 2B are perspective views of the dispenser assembly of FIG. 1, with a cover assembly in an open position in accordance with the present disclosure.
Figure 2B:
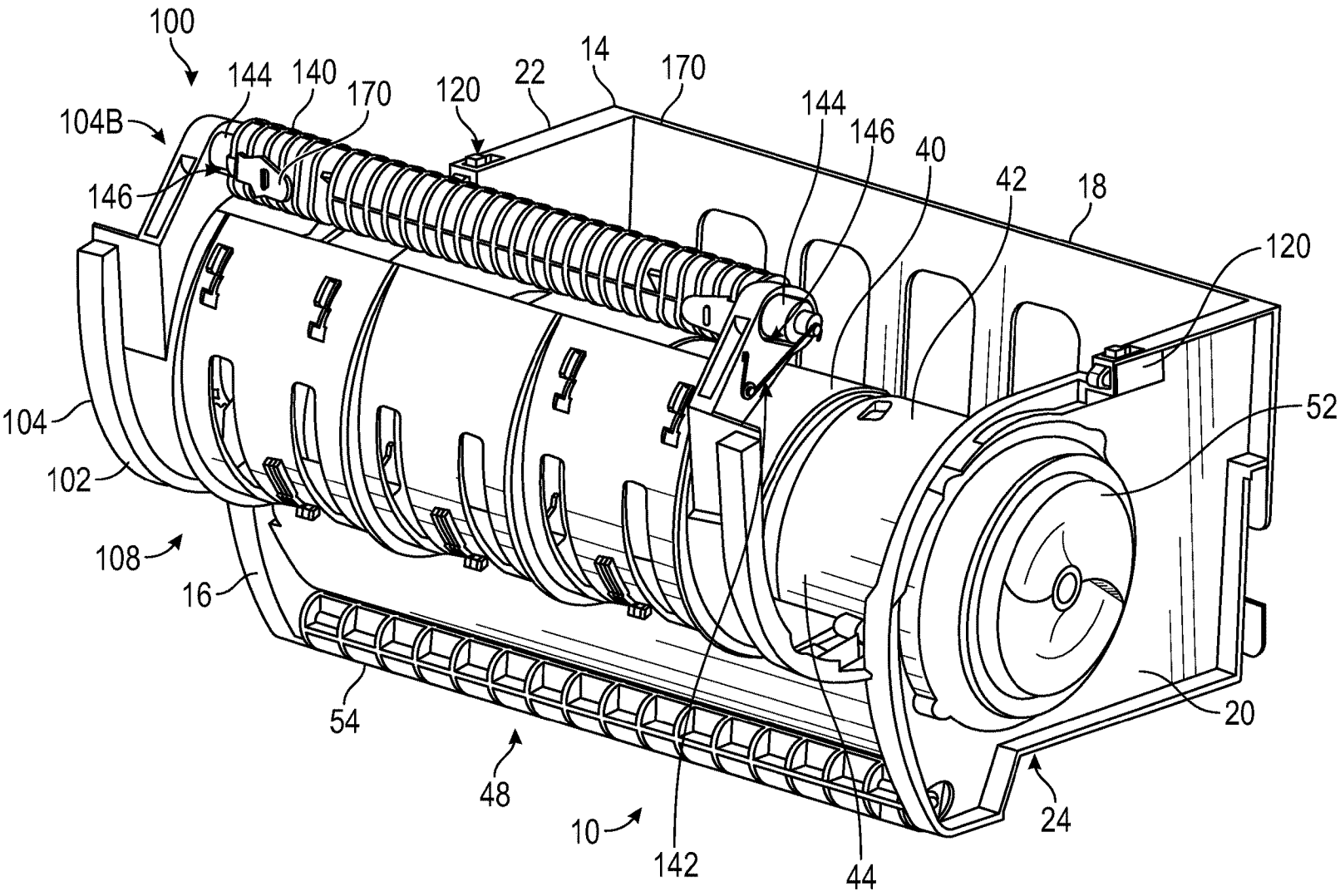

The base 324 further will be rotatably or pivotally coupled to at least a portion of the feed roller 40. For example, as indicated in FIGS. 2A and 7B, the cutting assembly 320 can be connected to the feed roller 40 by a pivoting or rotatable connection 346, and can move/rotate with rotation of the feed roller 40 during dispensing of the sheet material. The cutting assembly 320 also can include one or more biasing members, such as torsion springs, or other suitable biasing members, that provide a biasing force against the support/base 324 sufficient to urge or bias the support/base 324, and thus the cutting blade 322, toward a retracted position.

FIGS. 7B and 9A further show that the base 324 also can have a cam follower assembly 352 arranged along the top portion 338 thereof. The cam follower assembly 352 generally will have one or more cam followers 354, which can include bearings, rollers, or other rotating members, and which are configured to engage and move along one or more corresponding cam surfaces or tracks 366 located within the cavity 42A of the feed roller body 42 as the feed roller 40 is rotated. As the feed roller rotates, the body will be correspondingly pivoted/rotated to move the cutting blade 322 out from and back into the opening/slot 332. For example, in one embodiment, the cutting assembly 320 can include a cam track 370 that can be mounted in a substantially fixed or stationary position within the cavity 42A of the feed roller body 42, such that the feed roller body 42 and the base 324 are rotated about such cam track 370, such as indicated in FIGS. 16A-E.

The cam track 370 further can have one or more sections 372 provided therealong that are engaged by the cam followers 350 to cause the base/support 324 to pivot, rotate, or otherwise move and thereby extend the cutting blade 322 out from the opening/slot 332 in the feed roller 40 for at least partial perforation or cutting of the sheet material.

U.S. patent application Ser. Nos. 15/848,643 and 15/185,937, which are specifically incorporated by reference herein as if set forth in their entireties, show example cutting systems that can be used in accordance with the present disclosure.

Figure 9B:
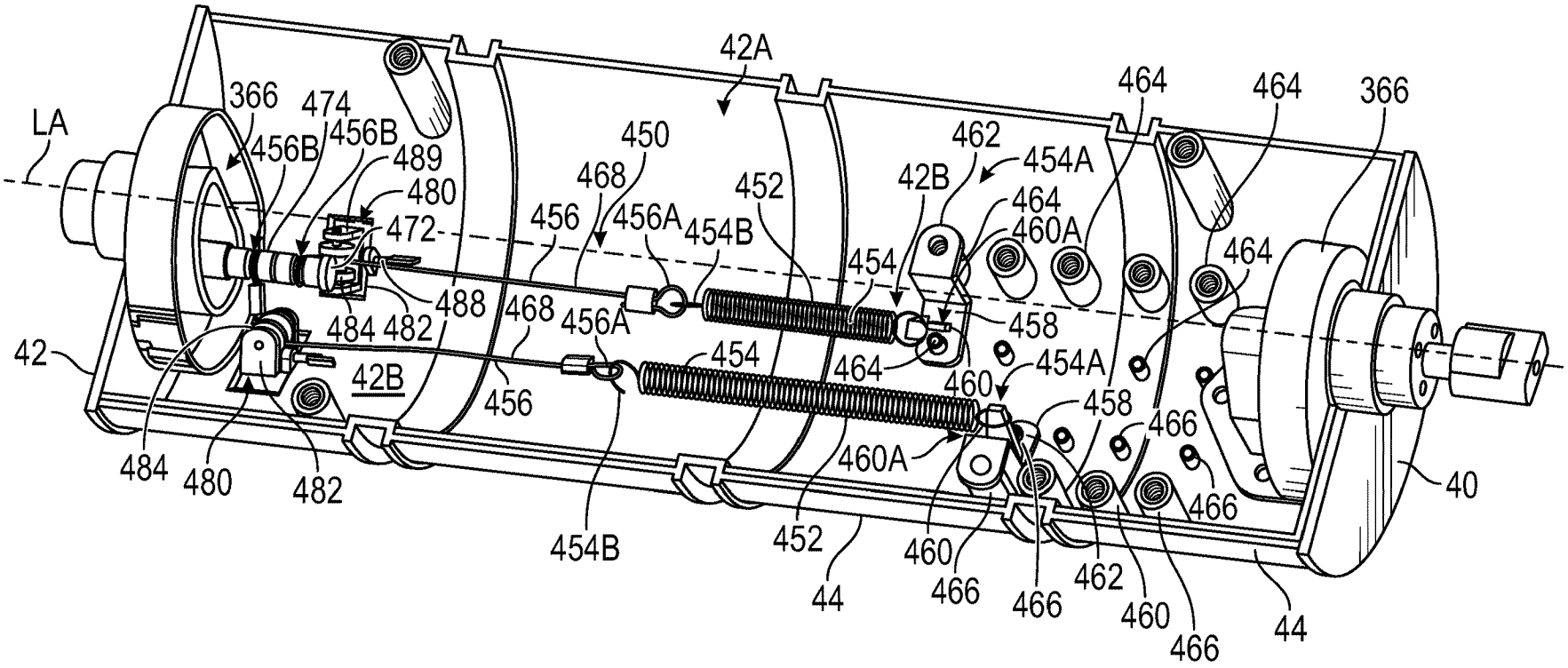
Figure 9C:
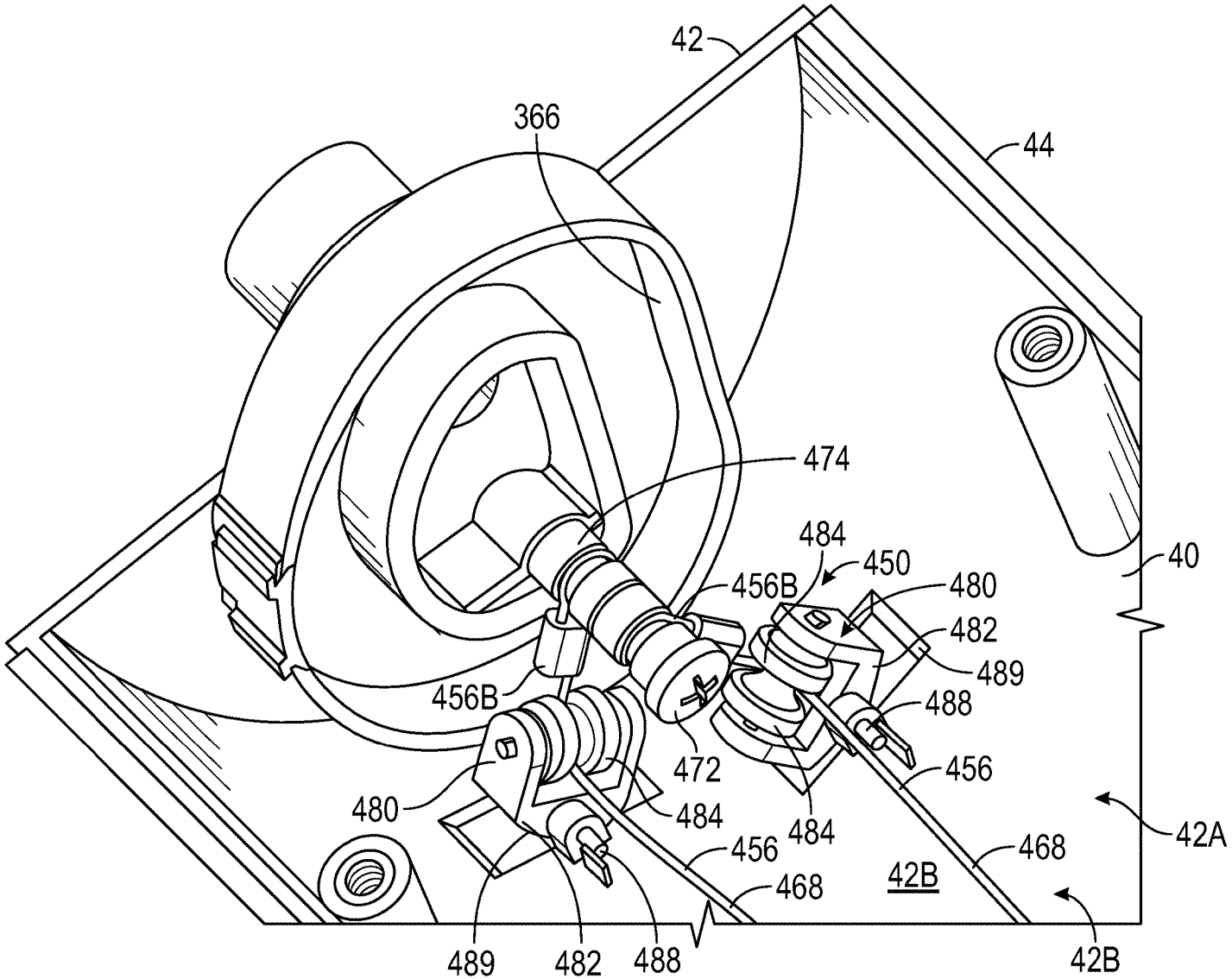

FIGS. 9B and 9C further show that the feed roller body 42, in some embodiments, can include a biasing assembly 450 disposed within cavity 42A and operable to assist rotation of the feed roller body 42 and movement of the cutting assembly 320, for example, upon manual activation of the feed roller body 42. An example biasing assembly is shown and described in U.S. Provisional Patent Application No. 62/741,350, which is specifically incorporated by reference herein as if set forth in its entirety.

As shown in FIG. 9B, the biasing assembly 450 can include one or more biasing members 452, e.g. in the embodiment illustrated, a pair of biasing members 452 are shown extending along the interior surface 42B of the feed roller body 42. It will be understood that fewer or additional biasing elements also can be used, without departing from the scope of the present disclosure. Each biasing member 452 can comprise a tension spring or other suitable tensioning or biasing member, having an elongated spring body 454 with first and second ends 454A/B. The biasing members 452 also generally extend in a direction that is parallel to the longitudinal (or rotational) axis LA (shown in FIG. 9B) of the feed roller body 328, and can be fixably attached to the interior surface 42B of the feed roller body 42.

The first or distal end 454A of each biasing member 452 can engage and couple to a connection mechanism 458, such as flange, arm, or other connecting member attached to the feed roller body 42 by one or more fasteners, (e.g., a screw, rivet, or other fastener). For example, in one embodiment, as illustrated in FIG. 9B, the first end 454A of the spring body 454 of each biasing member 452 can include a hoop, ring, hook or other suitable feature or mechanism that connects to a protruding portion 460 formed with, or connected to the connection mechanism 458, which portion 460 has a notch or opening 460A for receiving the hoop, ring, or hook of the spring. The second end 454B of each biasing member 452 can be similarly attached to a connecting linkage FIG. 9B.

In one embodiment, the connection mechanism 458 can include a body 462 that is connected to, or engages, portions or protrusions 464 and 466 fixed to, or integrally formed with, the feed roller body 42. The protrusions 464 and 466 can be received within openings or apertures defined along body 462 of the connection mechanism, and/or can include threaded openings defined therein to receive fasteners passed through the openings of the body 462 of the connection mechanism to secure the body 462 to the feed roller body 42. The body 462 can have a generally Z-shaped cross-section to facilitate connection of the body 462 to the portions 464/466, though the body can have other suitable shapes and configurations, without departing from the scope of the present disclosure.

In one variation or alternative construction, the feed roller body 42 can have a plurality of attachment points 464/466 about interior surface 329 thereof. For example, the feed roller body 328 can have multiple portions 464/466 formed/connected to the feed roller 40 in spaced series to allow for adjustment (e.g., tightening or loosening) of the biasing members 452, e.g., to accommodate different sheet material sizes and/or to correct for time dependent displacement or movements of the spring due to the repeated loading. In one embodiment, up to five attachment points can be provided, though any suitable number of attachment points, e.g., 2, 3, 4, or more than 5, can be employed without departing from the scope of the present disclosure.

FIGS. 9B and 9C further show that each linkage 456 can include a wire, band, belt, or rod 468, or other flexible coupling. The first end 456A of each linkage 456 can be formed as a looped end, and can be connected to a second end 454B of a corresponding biasing member 454 such as by a hook, hoop, or split-ring type of connection forming the second end 454B of the biasing member 454. The second end 456B of each linkage 456 can be formed with a similar looped end and generally will be rotatably connected to a portion, such as tracks 366, that does not rotate, e.g., is fixed in relation to, the feed roller, such as by attachment to a fastener 472 (e.g., screw, bolt, etc.) or other suitable connection mechanism. The fastener 472 also can have one or more spacers 474 received therealong to engage and facilitate alignment of the second looped ends 456B of the linkages 456 (FIGS. 9B and 9C).

Additionally, the biasing assembly 450 can include one or more pulley assemblies 480 (as shown in FIGS. 9B and 9C) that engage and facilitate a change in the direction of the linkages 456 operatively connecting the biasing members 452 to the feed roller body 42. Each of the pulley assemblies 480 can include a bracket 482 that is connected to the interior surface 329 of the feed roller body 328 and that at least partially supports a pulley 484 having a track or race 486 against which at least a portion of the linkage 456 is engaged and/or moves.

As shown in FIGS. 9B and 9C, the pulley brackets 482 can be pivotably or rotatably mounted (e.g., by a pinned or hinged connection 488) to the interior surface 42B of the feed roller body 328. The pinned or hinged connection 488 can help to maintain engagement between, or substantially prevent misalignment of, the linkage 456 and the pulleys 484, e.g., as/when the feed roller body 42 is rotated and the biasing assembly 450 is rotated therewith. The interior surface 42B of the feed roller body 42 further can have a notch or recessed portion 489 formed/defined therein to accommodate movement/pivoting of the brackets 482.

In operation, upon activation of the feed roller 40 (e.g., when a user pulls a hanging tab or portion of sheet material or turns the knob or lever 52 connected to the feed roller body 42), the feed roller body 42 rotates and carries the biasing assembly 450 therewith. As a result, the linkages 456 are caused to be pulled or otherwise engaged about the pulleys 484, tensioning and stretching the spring bodies of the biasing members 452, thus creating tension in or along the biasing members 452. This tension assists in the rotation of the feed roller body 40 and helps urge the feed roller body 42 to facilitate return of the feed roller body 40 to a rest or home position. In one example, the rotation of the feed roller 40 can be sufficient to generate a tab or portion for pulling or engagement by subsequent users for dispensing a selected portion of sheet material. Also, this tension helps facilitate rotation of the feed roller body 42 sufficient to cause activation or movement of the cutting blade 322 of the dispenser assembly 10 to cut, perforate, or otherwise cause or assist in separation of a sheet of the sheet material. The return movement of the feed roller body 42 also can cause retraction of the cutting blade 322 (e.g., into notch, recess in the feed roller body 42).

The foregoing description generally illustrates and describes various embodiments of this disclosure. It will, however, be understood by those skilled in the art that various changes and modifications can be made to the above-discussed constructions and systems without departing from the spirit and scope of this disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of this disclosure. Accordingly, various features and characteristics as discussed herein may be selectively interchanged and applied to other illustrated and non-illustrated embodiment, and numerous variations, modifications, and additions further can be made thereto without departing from the spirit and scope of the present invention as set forth in the appended claims.

What is claimed is:

1. A dispenser, comprising:

a dispenser housing that at least partially supports a plurality of supplies of sheet material, and having a discharge from which sheet material from the plurality of supplies of sheet material is dispensed;

a feed roller rotatably connected to the dispenser housing, the feed roller comprising a feed roller body configured to engage and feed sheet material from one of the plurality of supplies of sheet material along a feed path a towards the discharge of the dispenser housing;

a cover assembly including a cover body connected to the dispenser housing and movable between a closed position and an open position to facilitate loading of the plurality supplies of sheet material into the dispenser housing, and a roller that is rotatably connected to the cover body and configured to engage at least a portion of sheet material from one or more of the plurality of supplies of sheet material; and a transfer mechanism configured to transfer feeding between the plurality of supplies of sheet material and operatively connected to the roller of the cover assembly, such that when sheet material from one of the plurality of supplies of sheet material has been substantially dispensed, the transfer mechanism facilitates movement of the roller of the cover assembly toward engagement with the feed roller body to initiate dispensing of sheet material from a different one of the plurality of supplies of sheet material.

2. The dispenser of claim 1, wherein the transfer mechanism comprises a transfer arm operatively connected to the roller and movable between a plurality of feeding positions for transfer of the feeding of sheet material between the plurality of supplies of sheet material, the plurality of feeding positions including a first feeding position in which the transfer arm holds the roller away from the feed roller body, and a second feeding position in which the transfer arm is moved to a position to enable engagement between the roller and feed roller body such that at least a portion of the sheet material from a different one of the plurality of supplies of sheet material is pressed against the feed roller body to initiate dispensing of the sheet material from the second supply.

3. The dispenser of claim 2, wherein the transfer mechanism further includes at least one guide roller that is configured to engage the sheet material from a first supply of sheet material of the plurality of supplies of sheet material, and at least one fixed support positioned substantially adjacent to the transfer arm and configured to engage the sheet material from first supply such that it is engaged between the at least one guide roller and the at least one fixed support with the transfer arm in its first feeding position.

4. The dispenser of claim 3, wherein the at least one guide roller and the at least one fixed support are configured to intermesh when the sheet material from the first supply of sheet material is substantially dispensed to facilitate movement of the transfer mechanism from its first position towards its second position.

5. The dispenser of claim 4, wherein one or more portions of the at least one guide roller are received within one or more spaces defined along the at least one fixed support and/or one or more portions of the at least one fixed support are positioned into one or more spaces defined along the at least one guide roller when the sheet material from the first supply is substantially dispensed and no longer present between the at least one fixed support and the at least one guide roller.

6. The dispenser of claim 2, wherein the transfer mechanism further includes one or more biasing members configured to bias the transfer arm towards its second feeding position.

7. The dispenser of claim 2, wherein the roller includes at least one bearing connected thereto or formed therewith that connects the roller to the cover body, and wherein the transfer arm includes at least one projecting portion that engages at least a portion of the at least one bearing with the transfer arm in its first feeding position.

8. The dispenser of claim 1, further comprising a cutting assembly that is integrated with the feed roller and includes one or more cutting portions that are extensible into and out from one or more openings defined in the feed roller body.

9. The dispenser of claim 1, further comprising an engagement portion that is operatively connected to the feed roller and configured to be actuated by a user to drive rotation of the feed roller for manual dispensing of the sheet material from the dispenser.

10. The dispenser of claim 1, further comprising a biasing assembly configured to assist rotation of the feed roller, the biasing assembly including at least one biasing member connected to the feed roller body, and at least one linkage connected to the at least one biasing member and at least one portion that does not rotate with the feed roller body.

11. A sheet material dispenser, comprising:

a dispenser housing within which one or more supplies of sheet material are received, and which includes a discharge from which sheet material from the one or more supplies of sheet material is dispensed;

a feed roller rotatably connected to the dispenser housing and having a feed roller body configured to engage and feed the sheet material from the one or more supplies sheet material along a feed path and towards the discharge of the dispenser housing; and a sheet material loading assembly including a cover rotatably connected to at least a portion of the dispenser housing at a first end and movable between a closed position and an open position to facilitate loading of the one or more supplies of sheet material into the dispenser housing, and at least one roller that is rotatably connected to a second end of the cover, the at least one roller being configured to receive at least a portion of sheet material from at least one supply of the one or more supplies of sheet material thereabout with the cover in its open position, and to urge the portion of sheet material toward engagement with the feed roller body, with the cover in its closed position, to initiate feeding of the sheet material from the at least one supply for dispensing from the dispenser, wherein the at least one roller further includes at least one sheet material retention portion that is configured to couple the portion of the sheet material to the at least one roller.

12. The sheet material dispenser of claim 11, wherein the sheet material loading assembly includes one or more biasing members coupled to the cover and operatively connected to the at least one roller so as to bias the roller toward engagement with the feed roller body when the cover is in its closed position.

13. The sheet material dispenser of claim 11, wherein the sheet material loading assembly includes one or more biasing members connected to the cover and biasing the cover toward its open position, and one or more locking features configured to secure the cover in its closed position.

14. The sheet material dispenser of claim 11, wherein the at least one sheet material retention portion comprises a plurality of sheet material retention portions that are configured to couple the portion of the sheet material to the at least one roller.

15. The sheet material dispenser of claim 11, wherein the one or more supplies of sheet material include at least first and second supplies of sheet material, and wherein the sheet material dispenser further comprises a transfer assembly configured transfer feeding between the first and second supplies of sheet material, the transfer assembly including a transfer arm operatively connected to the at least one roller of the sheet material loading assembly and is movable between a plurality of feeding positions to facilitate transfer of feeding of sheet material between the first and second supplies of sheet material, the plurality of feeding positions including a first feeding position in which the transfer arm holds the at least one roller of the sheet material loading assembly away from the feed roller body, and a second feeding position in which the transfer arm enables engagement between the at least one roller of the sheet material loading assembly and the feed roller body such that the portion of sheet material from the first supply is pressed against the feed roller body to initiate dispensing of the sheet material from the first supply.

16. The sheet material dispenser of claim 15, wherein the transfer assembly further includes at least one guide roller that is configured to engage sheet material from second supply of sheet material, and at least one fixed support positioned substantially adjacent to the transfer arm and configured to engage the sheet material from the second supply of sheet material between the at least one guide roller and the at least one fixed support with the transfer arm in its first feeding position, wherein the at least one guide roller and the at least one fixed support are configured to intermesh when the sheet material from the second supply of sheet material is substantially dispensed to facilitate movement of the transfer arm from its first position towards its second position.

17. The sheet material dispenser of claim 11, further comprising one or more pressing rollers mounted along the discharge so as to engage and direct the sheet material along the feed path as the sheet material is fed from the discharge.

18. The sheet material dispenser of claim 11, further comprising a cutting assembly that is integrated with the feed roller and includes one or more cutting portions that are extensible through one or more openings defined in the feed roller body.

19. The sheet material dispenser of claim 11, further comprising an engagement portion that is operatively connected to the feed roller and configured to be actuated by a user to drive rotation of the feed roller and control dispensing of the sheet material from the dispenser assembly.

20. The sheet material dispenser of claim 11, further comprising a biasing assembly configured to assist rotation of the feed roller, the biasing assembly including at least one biasing member connected to the feed roller body, and at least one linkage connected to the at least one biasing member and at least one portion that does not rotate with the feed roller body.

21. The sheet material dispenser of claim 11, wherein the at least one sheet material retention portion comprises a biased clip that is pressed against an outer surface of the at least one roller and is movable away from the at least one roller for allowing the sheet material to be positioned between the biased clip and the outer surface of the at least one roller.

22. The sheet material dispenser of claim 11, wherein the cover has a plurality of sheet material guide fingers configured to engage the sheet material against the feed roller body.

* * * * *